US007581266B2

(12) United States Patent
Krecow et al.

(10) Patent No.: US 7,581,266 B2
(45) **Date of Patent: *Sep. 1, 2009**

(54) CALF SUPPORT ASSEMBLY FOR A MATERNITY BED FOOT SUPPORT AND ABDUCTION ASSEMBLY

(75) Inventors: Arlene Krecow, Mattawan, MI (US); John Zerbel, Paw Paw, MI (US); Cory P. Herbst, Shelbyville, MI (US); Andras Kupfermann, Grand Rapids, MI (US); Joseph T. Brophy, Rockford, MI (US)

(73) Assignee: Stryker Corporation, Kalamazoo, MI (US)

( * ) Notice: Subject to any disclaimer, the term of this patent is extended or adjusted under 35 U.S.C. 154(b) by 373 days.

This patent is subject to a terminal disclaimer.

(21) Appl. No.: 11/448,536

(22) Filed: Jun. 6, 2006

(65) Prior Publication Data

US 2006/0225215 A1 Oct. 12, 2006

Related U.S. Application Data

(63) Continuation-in-part of application No. 11/004,705, filed on Dec. 3, 2004, now Pat. No. 7,127,756.

(51) Int. Cl.
*A61G 13/12* (2006.01)

(52) U.S. Cl. ..... 5/624; 5/602; 5/648; 5/651

(58) Field of Classification Search ..... 5/624, 5/648–651, 602; 602/24, 27; 128/882
See application file for complete search history.

(56) References Cited

U.S. PATENT DOCUMENTS 2,275,973 A 3/1942 Marchbanks
2,552,370 A 5/1951 Curtis
2,605,151 A 7/1952 Shampaine
3,492,679 A 2/1970 Drew (Continued)

FOREIGN PATENT DOCUMENTS

GB 535305 4/1941

OTHER PUBLICATIONS

Stryker Adel 2100 Childbearing Bed, Service Manual, 1988, pp. 1-28.

(Continued)

*Primary Examiner*—Michael Trettel
(74) *Attorney, Agent, or Firm*—Van Dyke, Gardner, Linn & Burkhart, LLP

(57) ABSTRACT

A foot support and abduction assembly includes an abductor-mounted foot support configured for pivotal attachment proximate a foot end of a maternity bed. A calf support assembly, for mounting to the foot support, includes a housing for removably attaching the calf support to the foot support. The housing includes a spring-biased pin for releasably securing the housing to the foot support and at least one mounting stud configured for insertion into a keyhole aperture on the foot support. A calf support portion is adjustably mounted to the housing by a ball-type pivot mount. An adjustment mechanism is provided for selectively fixing the position of the calf support portion relative to the housing. The adjustment mechanism includes a slidable sleeve for locking the ball-type pivot, and a threaded rod or a cam shaft arranged to shift the slidable sleeve.

25 Claims, 41 Drawing Sheets

U.S. PATENT DOCUMENTS

| | | | | |
|---|---|---|---|---|
| 4,025,972 | A | 5/1977 | Adams et al. | |
| 4,097,939 | A | 7/1978 | Peck et al. | |
| 4,139,917 | A | 2/1979 | Fenwick | |
| 4,225,127 | A | 9/1980 | Strutton | |
| 4,411,035 | A | 10/1983 | Fenwick | |
| 4,431,329 | A | 2/1984 | Baitella | |
| 4,639,954 | A | 2/1987 | Speed | |
| 4,828,910 | A | 5/1989 | Haussling | |
| 4,860,394 | A | 8/1989 | Benessis et al. | |
| 4,894,876 | A | 1/1990 | Fenwick | |
| 5,148,562 | A | 9/1992 | Borders et al. | |
| 5,157,800 | A | 10/1992 | Borders | |
| 5,214,812 | A | 6/1993 | Bartow et al. | |
| 5,226,187 | A | 7/1993 | Borders et al. | |
| 5,329,657 | A | 7/1994 | Bartley et al. | |
| 5,423,097 | A | 6/1995 | Brulé et al. | |
| 5,774,914 | A | 7/1998 | Johnson et al. | |
| 5,926,878 | A | 7/1999 | Morton et al. | |
| 6,654,974 | B2 | 12/2003 | Ruchl et al. | |
| 6,757,924 | B2 | 7/2004 | Goodwin et al. | |
| 6,983,501 | B2 * | 1/2006 | Heimbrock et al. | 5/602 |
| 7,127,756 | B2 * | 10/2006 | Brophy et al. | 5/602 |
| 2005/0001116 | A1 | 1/2005 | Vogt | |

OTHER PUBLICATIONS

Stryker Adel 500XL Childbearing Bed, Service Manual 1986 pp. 1-16.

Stryker Adel 2100EC Childbearing Bed, Ultimate convenience and comfort, Jan. 1994 (6 pages).

Stryker Adel 500XL Childbearing Bed, May 1995 (2 pages).

Stryker Medical, Labor & Delivery Model 5000 Series, Oct. 1996.

Co-pending U.S. Appl. No. 11/004,703, filed Dec. 3, 2004, Patient Support Apparatus With Removable Foot Section.

International Search Report and Written Opinion of the International Searching Authority, Blainer R. Copenheaver, for PCT Application No. PCT/US2007/013279 dated Sep. 17, 2008.

* cited by examiner

CALF SUPPORT ASSEMBLY FOR A MATERNITY BED FOOT SUPPORT AND ABDUCTION ASSEMBLY

CROSS-REFERENCE TO RELATED APPLICATIONS

This application is a continuation-in-part of U.S. patent application Ser. No. 11/004,705, filed Dec. 3, 2004, now U.S. Pat No. 7,127,756, and entitled MATERNITY BED FOOT SUPPORT AND ABDUCTION ASSEMBLY.

FIELD OF THE INVENTION

The invention relates to hospital beds and, more particularly, to a calf support for a foot support and abduction assembly for a maternity bed, designed to ease the birthing process for both the mother and the medical personnel that are assisting her.

BACKGROUND OF THE INVENTION

An example of a foot support and abduction assembly can be found in U.S. Pat. No. 5,926,878, wherein the foot support and abduction assembly are mounted proximate a leg-foot section of a maternity bed. The foot support is rotatably mounted to an upright support and is rotatable from a first, use position to a second position wherein a leg support mounted on the back of the foot support is deployed to a use position. The upright support is rotatably and slidably mounted to an abductor and is rotatable from the upright, use position to an under-bed stowed position. The abductor is rotatably mounted to the maternity bed. Each movement of one of these elements requires release of a locking mechanism configured to secure the element in a selected position. Each release for a locking mechanism and movement of an element requires a two-handed operation by the attendant.

When the upright support, with attached foot support, is in the under-bed, stowed position, it has been found advantageous to have the sliding connection between the abductor and the upright support unlocked so that the upright support can be moved easily, or will give way if struck by hospital equipment or attendants. The attendant must remember to unlock the sliding mechanism when stowing the upright support.

It would be advantageous to provide integrated locking mechanisms for each element of the foot support and abduction assembly.

SUMMARY OF THE INVENTION

A foot support and abduction assembly includes an abductor configured for pivotal attachment proximate a foot end of a maternity bed. The foot support is configured for locating in a stowed position below the abductor, and a calf support assembly is attached to an undersurface of the foot support. An upright assembly has a first end that is secured to the abductor for longitudinal movement along a length of the abductor, a second end to which the foot support is movably mounted, and a locking mechanism for selectively securing the upright assembly in one of a plurality of positions along the length of the abductor. The upright assembly is further configured for movement from a deployed position to a stowed position, and the locking mechanism is unlocked when the upright assembly is in the stowed position.

A calf support assembly, for mounting to a foot support of a maternity bed, includes a housing for removably attaching the calf support to the foot support. The housing includes a spring-biased pin for releasably securing the housing to the foot support and at least one mounting stud configured for insertion into a keyhole aperture on the foot support. A calf support portion is adjustably mounted to the housing by a ball-type pivot mount. An adjustment mechanism is provided for selectively fixing the position of the calf support portion relative to the housing. The adjustment mechanism includes a slidable sleeve for locking the ball-type pivot, and a threaded rod or a cam shaft arranged to shift the slidable sleeve.

DETAILED DESCRIPTION OF THE PREFERRED EMBODIMENT

Figure 1:
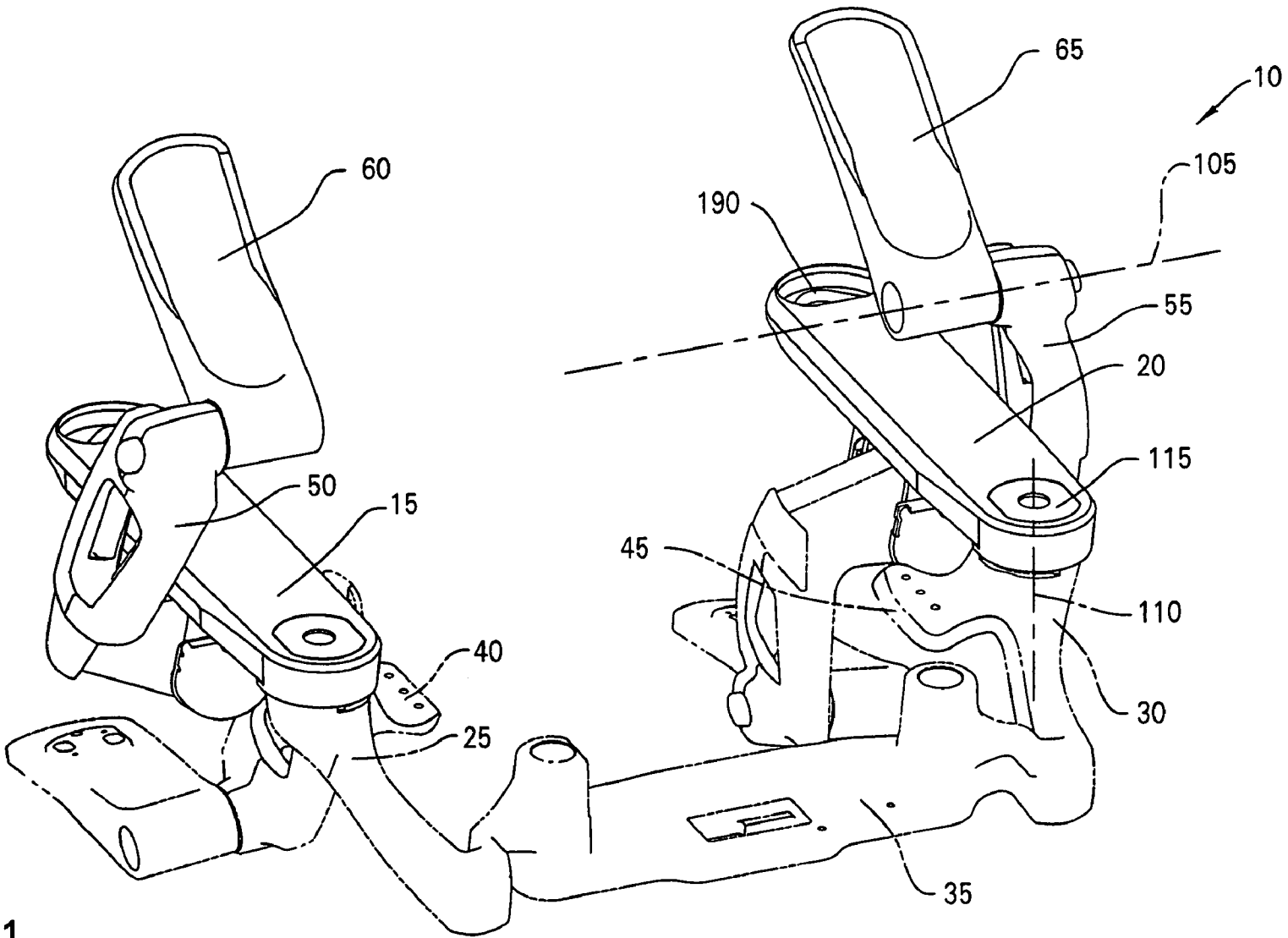
FIG. 1 is a perspective view of a maternity bed foot support and abduction assembly according to the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

Referring to FIG. 1, a maternity bed foot support and abduction assembly 10 is illustrated. The maternity bed foot support and abduction assembly 10 comprises a left abductor 15 and a right abductor 20, each pivotally attached to a respective stanchion 25, 30 formed as part of a bed foot lift casting 35 (shown in phantom). The bed foot lift casting 35 is configured for mounting to a foot end of a maternity bed (not shown). The bed foot lift casting 35 further includes a pair of integrally formed foot end support mounts 40, 45 configured for attaching a removable foot section of the maternity bed as disclosed in U.S. patent application Ser. No. 11/004 703, entitled "PATIENT SUPPORT APPARATUS WITH REMOVABLE FOOT SECTION", filed Dec. 3, 2004, incorporated herein by reference.

An upright assembly 50, 55 is pivotally attached to each of the abductors 15, 20 and pivotally supports a foot support 60, 65. As shown in FIG. 1, the upright assemblies 50, 55 are configured to pivot from an upright use orientation to a stowed orientation (shown in phantom) under the respective abductor 15, 20.

Further description of the maternity bed foot support and abduction assembly 10 will refer in detail to the right abductor 20 and pivotally supported upright assembly 55 and foot support 65. It is to be understood that the details of construction also apply to the left abductor 15 and associated upright assembly 50 and foot support 60, reversed as necessary for operating on the opposite side of the maternity bed.

Figure 2:
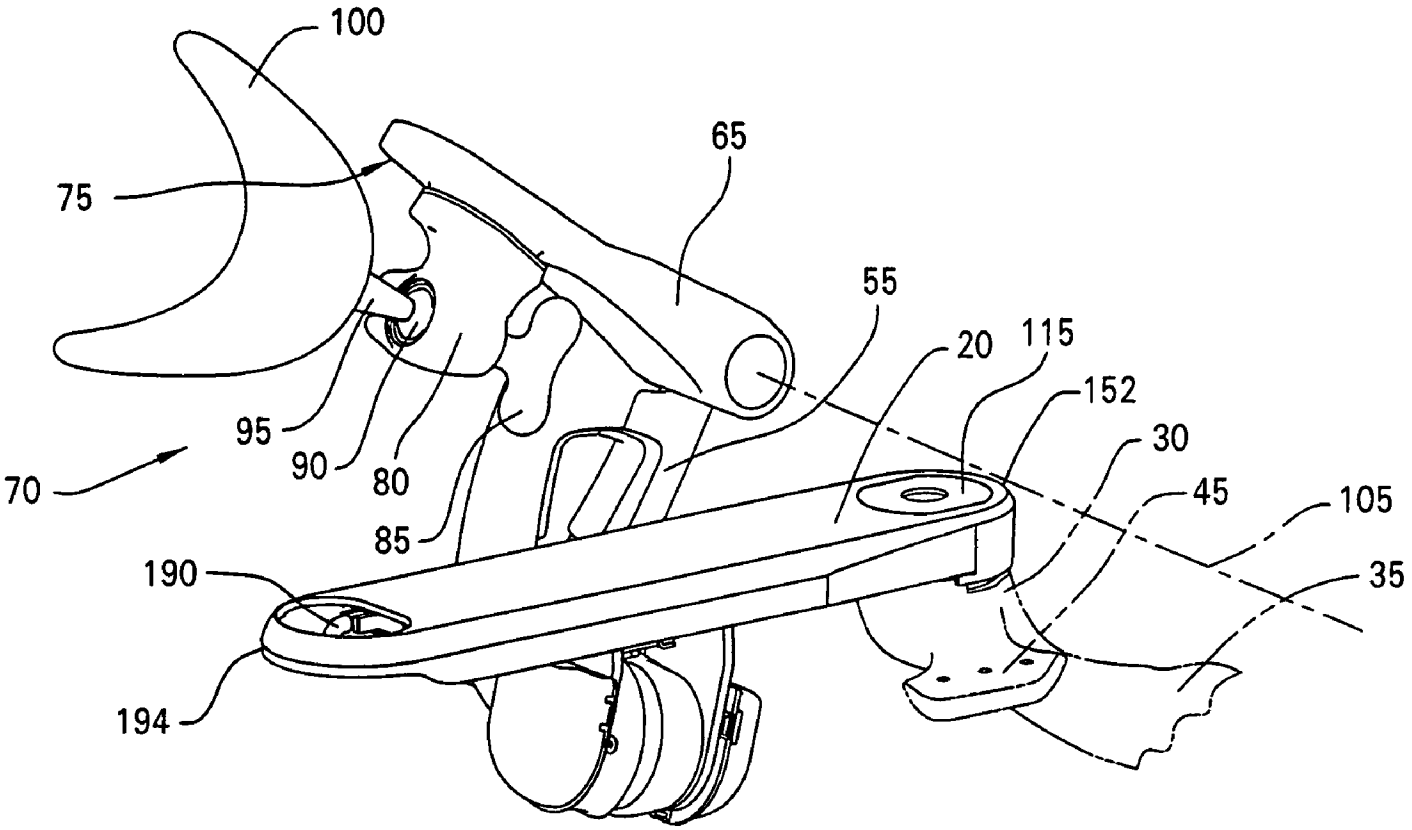
FIG. 2 is a perspective view according to FIG. 1 with an attached calf support assembly.

Referring to FIG. 2, a calf support assembly 70 is mounted to a reverse side 75 of the foot support 65. The calf support assembly 70 includes a mounting housing 80, a locking handle 85, a phenolic ball 90, a stanchion 95 and a calf support 100. The calf support 100 is configured for swivel adjustment relative to the housing 80. As will be further described below, the foot support 65 is pivotally mounted about a pivot axis 105 from a first position shown in FIG. 2, wherein the foot support 65 is directed toward a patient in the maternity bed, and a second position (not shown) wherein the foot support 65 is rotated toward the patient to present the calf support assembly 70 for use. In the remaining illustrations, the calf support assembly 70 has been omitted for clarity.

Figure 3:
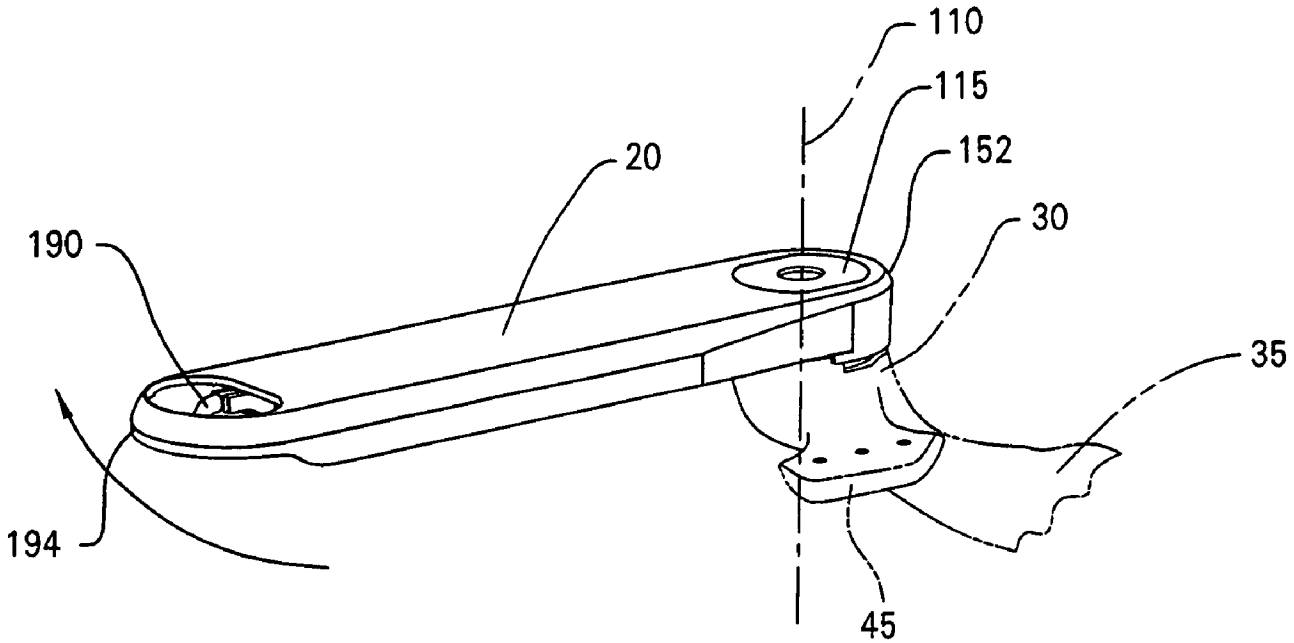
FIG. 3 is a perspective view of the abduction assembly according to FIGS. 1-2.
Figure 4:
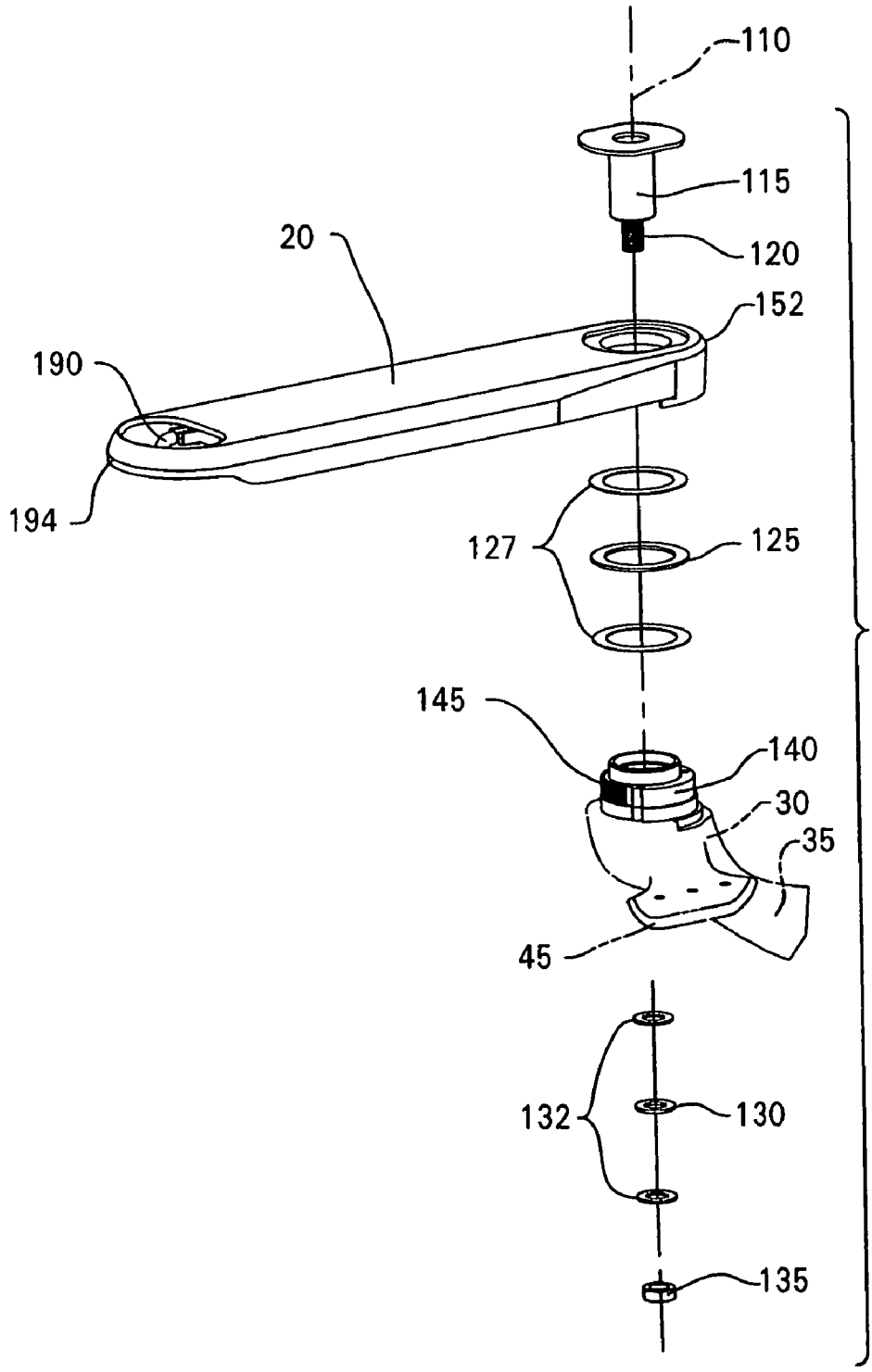
FIG. 4 is an exploded perspective view of the abduction assembly of FIG. 3.
Figure 5:
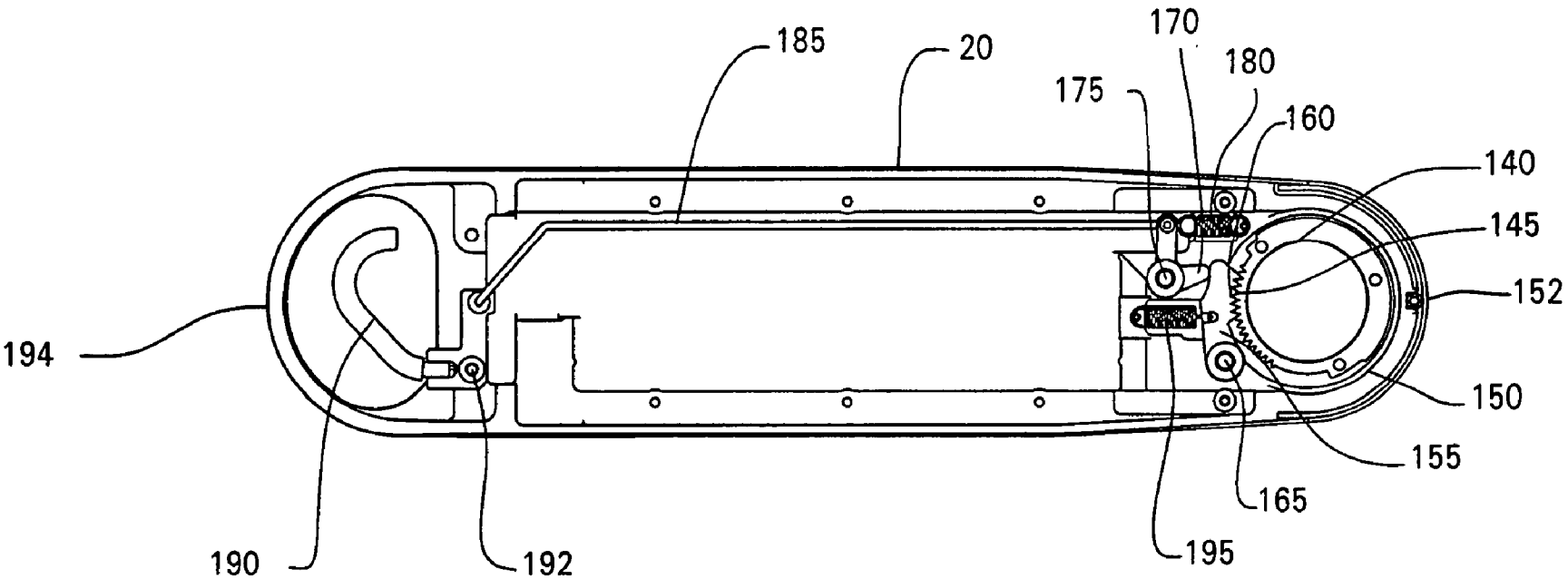
FIG. 5 is a bottom view of the abduction assembly of FIGS. 3-4.

Referring to FIGS. 3-5, the abductor 20 is pivotally mounted to the stanchion 30 of the bed foot lift casting 35 about a pivot axis 110. The abductor 20 is mounted to the stanchion 30 by a pivot shaft 115 having a threaded section 120. A pair of thrust bearings 125, 130 and washers 127, 132 are received on the pivot shaft 115 and threaded section 120, and secured by a nut 135 to enable the abductor 20 to rotate freely on the stanchion 30. The stanchion 30 further includes a ring gear 140 rotatably secured thereto having a plurality of teeth 145.

Referring to FIG. 5, the ring gear 140 is shown received in a cylindrical recess 150 within a proximal end 152 of the abductor 20. A latch member 155 having a plurality of teeth 160 is pivotally mounted by a pin 165 to the abductor 20. A locking cam 170 pivotally mounted to the abductor 20 by a pivot pin 175 is biased by a spring 180 to force the latch member 155 into engagement with the ring gear 140. The cam 170 is connected by a pull rod 185 to an abductor release handle 190 pivotally mounted to the abductor 20 by a pivot pin 192. The abductor release handle 190 is positioned at a distal end 194 of the abductor 20.

Figure 6:
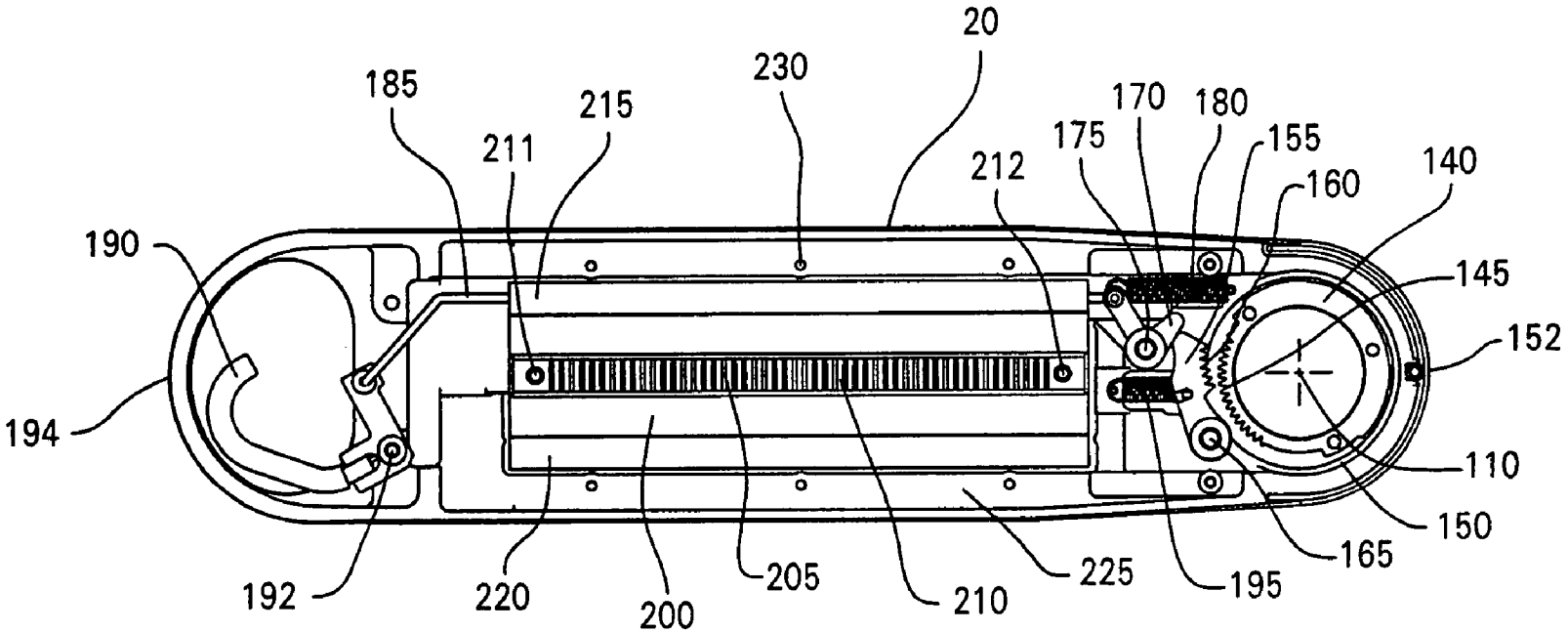
FIG. 6 is a bottom view of the abduction assembly according to FIGS. 3-5 with gear rack installed.

Referring to FIG. 6, actuation of the handle 190 draws the locking cam 170 away from the latch member 155. A spring 195 then draws the latch member 155 away from the ring gear 140 so that the teeth 145 of the ring gear 140 are no longer engaged with the teeth 160 of the latch member 155. With the teeth 145, 160 disengaged, the abductor 20 is free to pivot about the axis 110 on the stanchion 30. The springs 180, 195 are selected so that when the handle 190 is released, the spring 180 will overcome the spring 195 to urge the latch member 155 into engagement with the ring gear 140.

Figure 7:
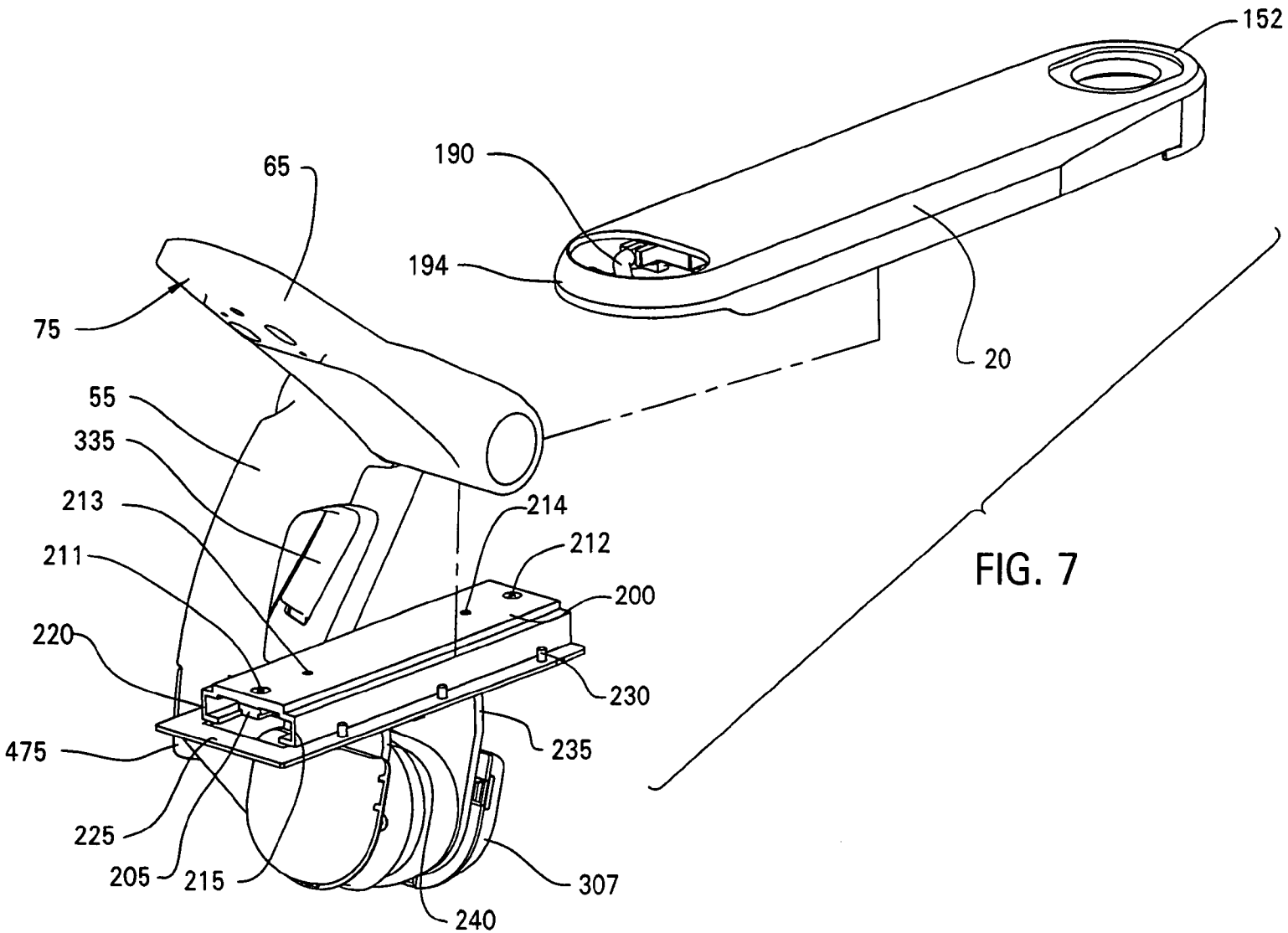
FIG. 7 is a perspective view of the foot support and abduction assembly according to FIGS. 1-6.

The abductor 20 further includes a rack assembly 200 including a longitudinal rack 205 having a plurality of teeth 210. The rack assembly further includes a pair of longitudinal tracks 215, 220. The rack assembly 200 is secured to the underside of the abductor 20 by a bottom cover 225, secured by a plurality of fasteners 230. The rack assembly 200 is configured for slidably receiving the upright assembly 55 (FIG. 7). The rack section 205 is secured to the rack assembly 200 by a pair of fasteners 211, 212 and a pair of pins 213, 214 (FIG. 8A).

Figure 8A:
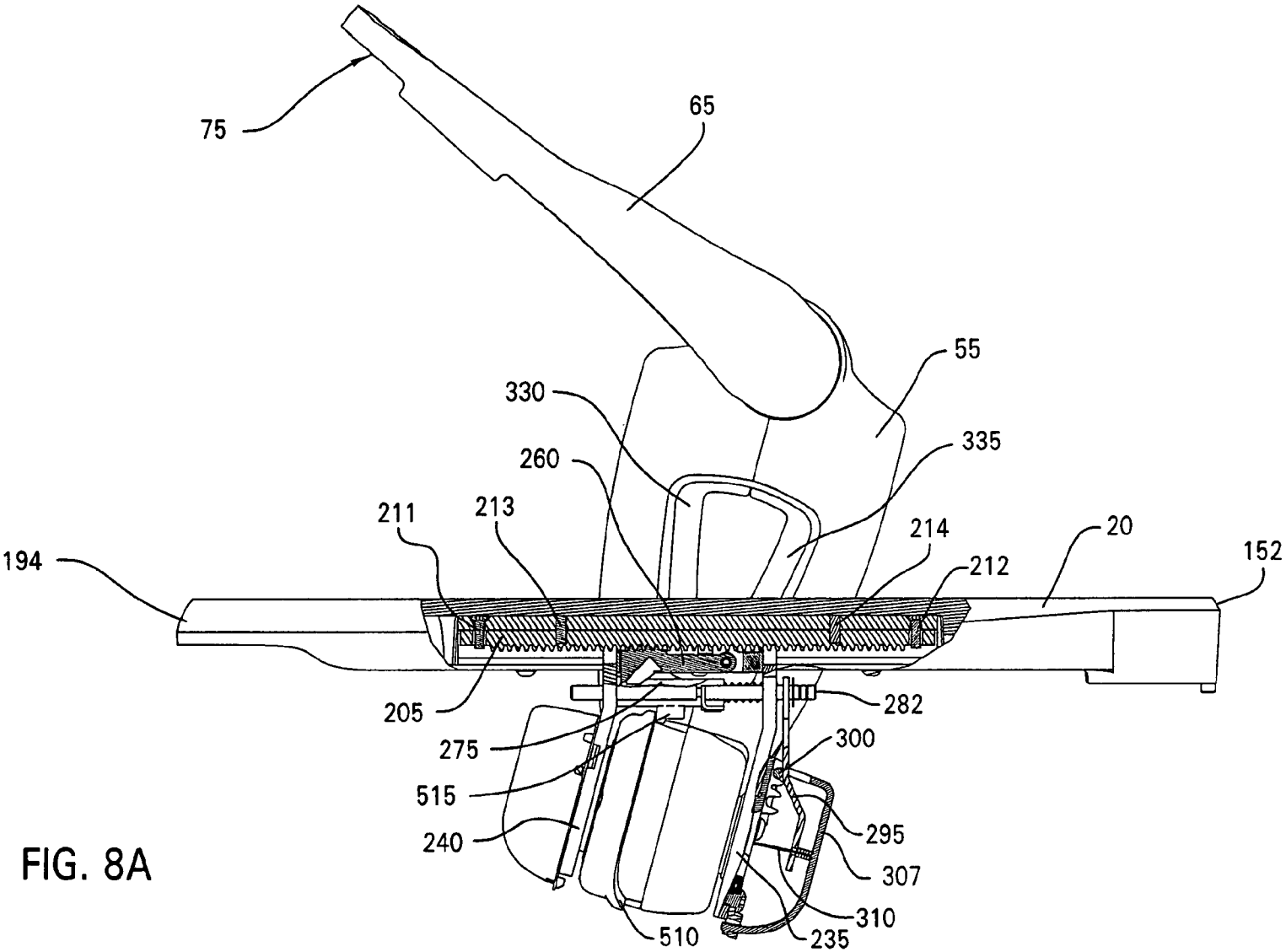
FIG. 8A is a partial cut-away side view of the foot support and abduction assembly according to FIGS. 1-7 in a locked position.
Figure 8B:
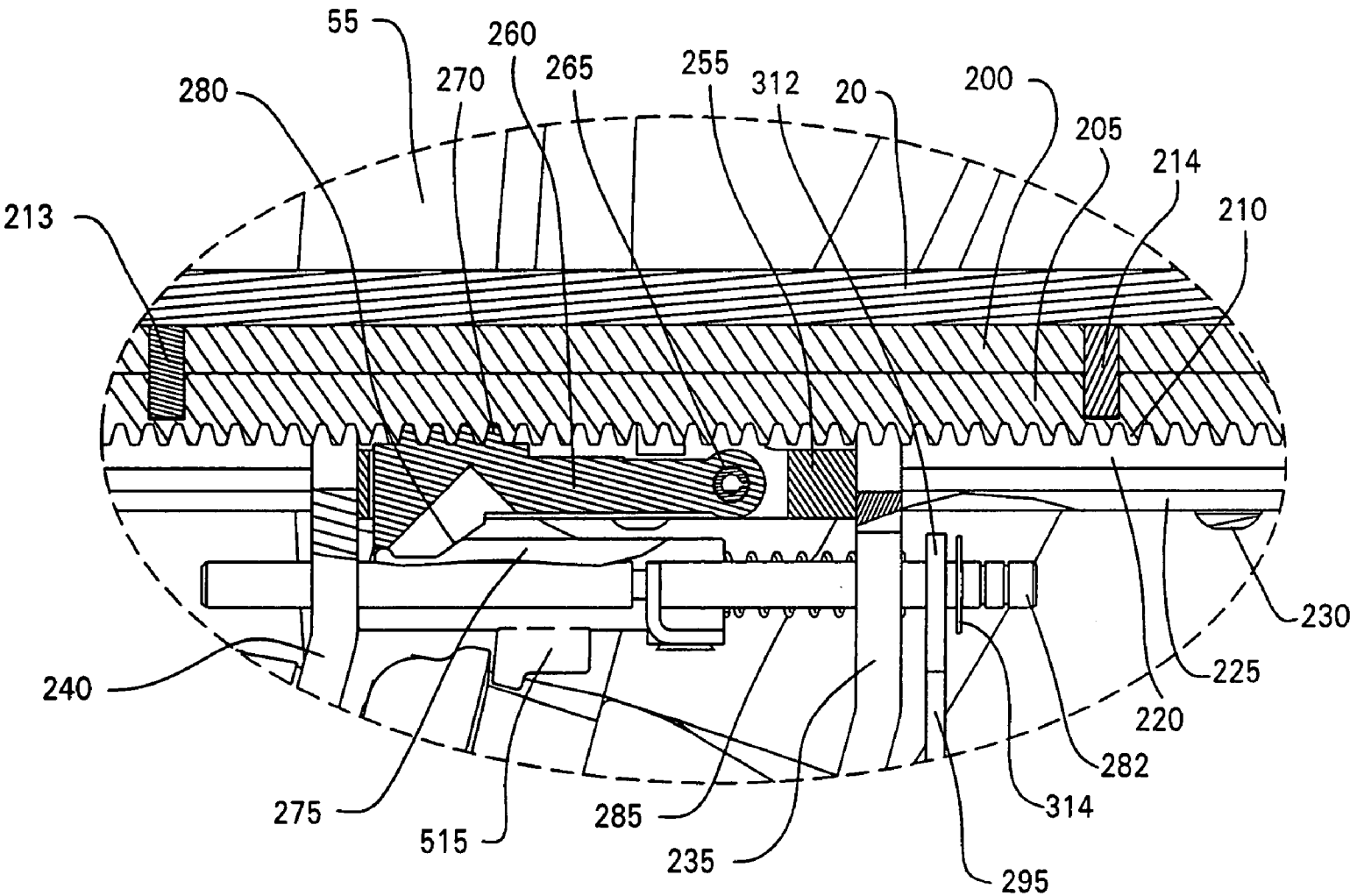
FIG. 8B is an enlarged detail view according to FIG. 8A.
Figure 12:
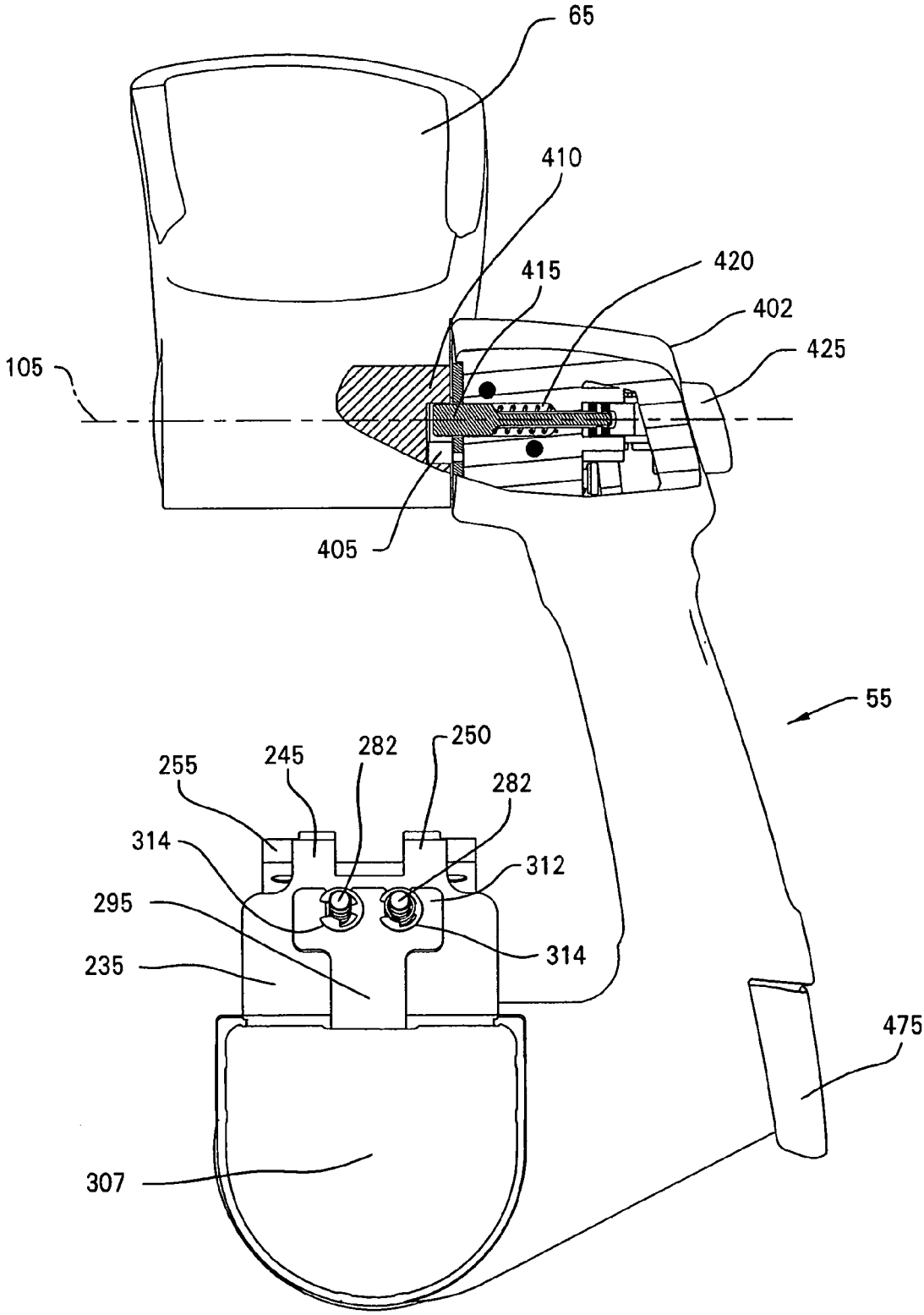
FIG. 12 is a partial cut-away end view of the upright assembly of FIGS. 10-11.

Referring to FIGS. 8A-8B, a partial cut-away view of the abductor 20 and upright assembly 55 is illustrated. The upright assembly 55 is slidably mounted to the abductor 20 and the rack assembly 200 by a pair of plates 235, 240. Plates 235, 240 include flanges 245, 250 (see FIG. 12) for straddling the rack 205. A mounting assembly 255 is fixed between the plates 235, 240 for engaging the tracks 215, 220 and the rack 205.

The mounting assembly 255 includes a locking arm 260 pivotally mounted by a pin 265 and including a plurality of teeth 270 configured for engaging the teeth 210 of the rack 205. The locking arm 260 is held upwardly and in engagement with the rack 205 by a cam wedge 275 having a locking projection 280. The cam wedge 275 is mounted on cam wedge rods 282 and is urged into a locked position of the locking arm 260 by a spring 285 bearing between the cam wedge 275 and the side plate 235.

Figure 9A:
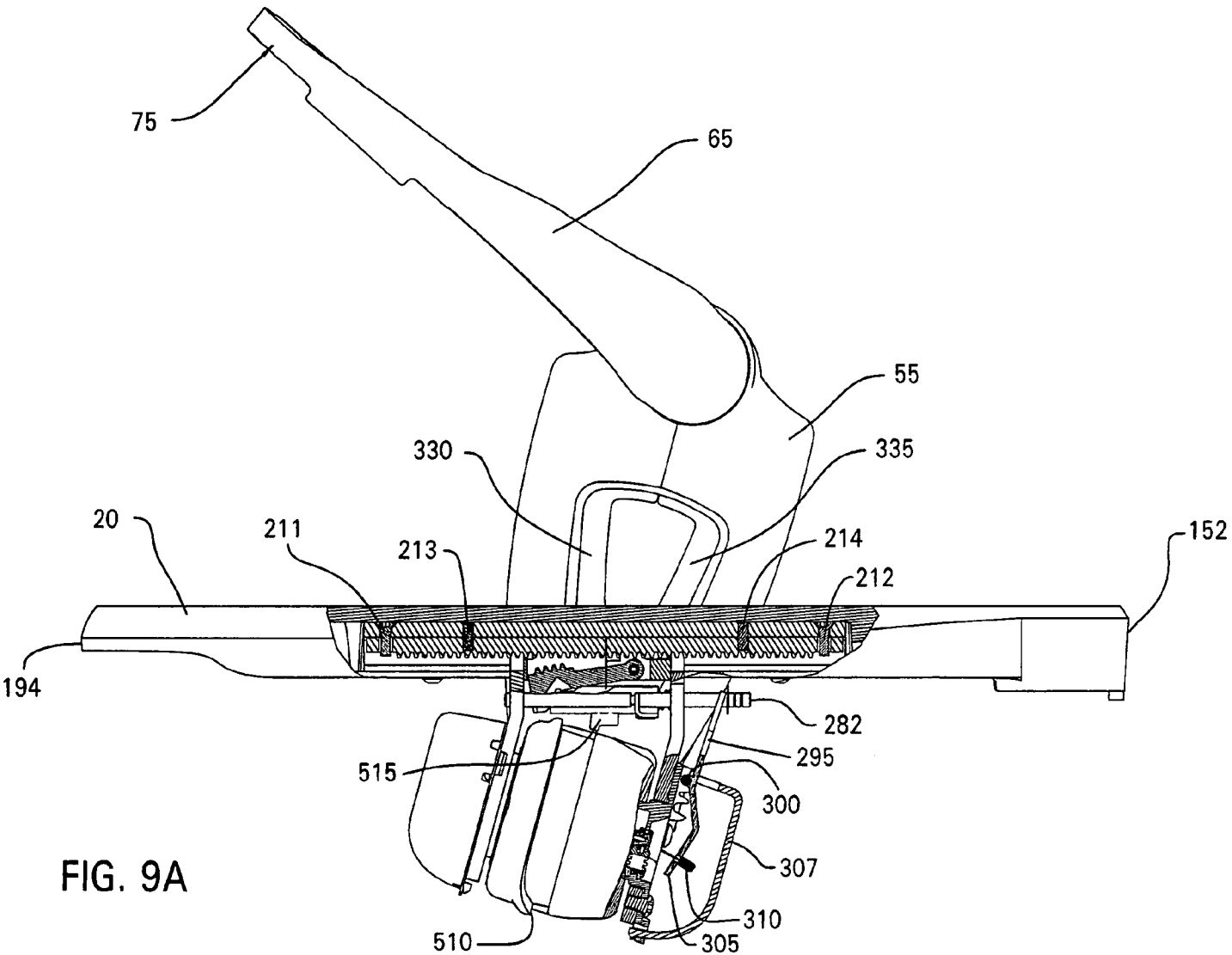
FIG. 9A is a partial cut-away side view of the foot support and abduction assembly of FIGS. 1-8 in an unlocked position.
Figure 9B:
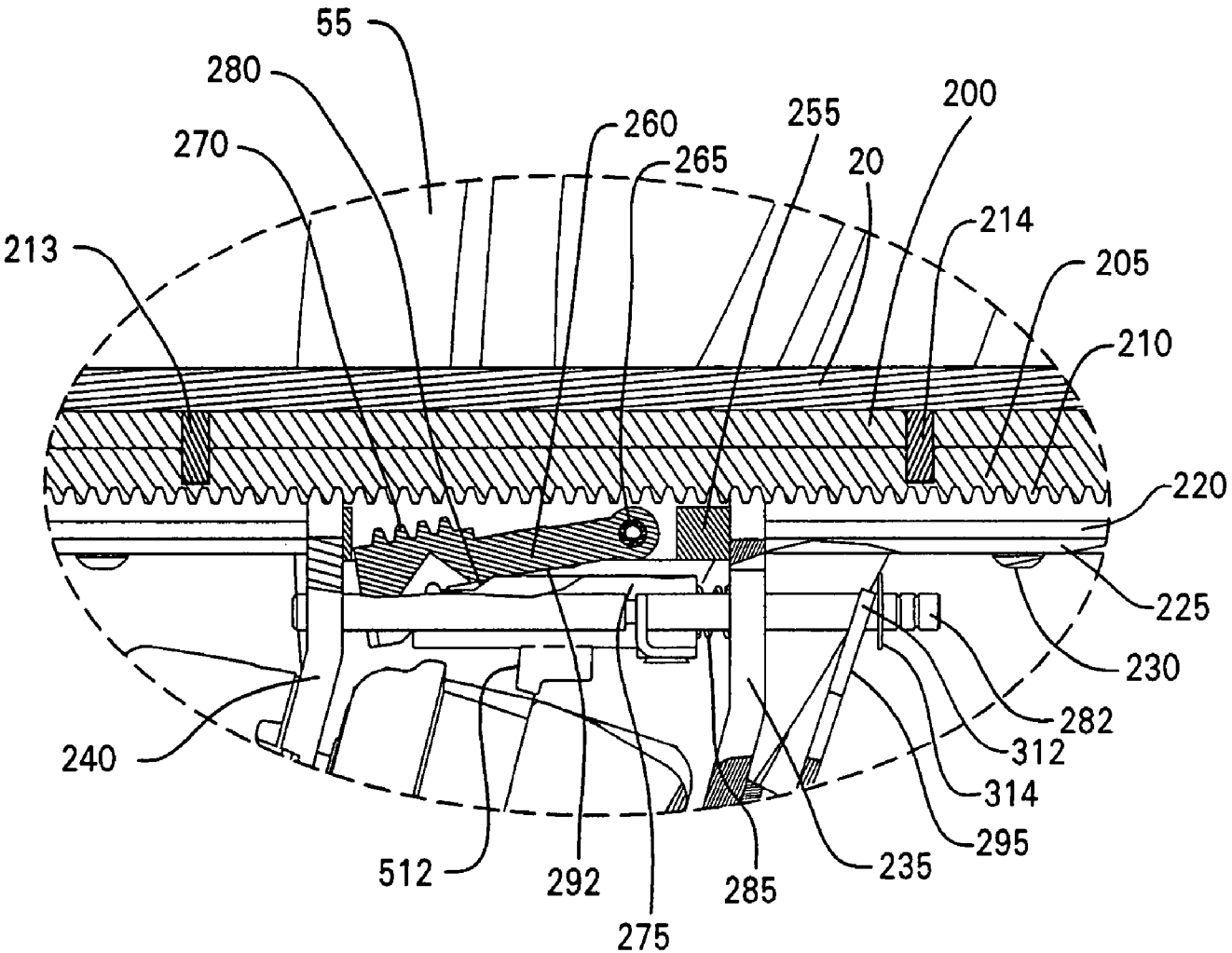
FIG. 9B is an enlarged detail view according to FIG. 9A.

Referring to FIGS. 9A-9B, to disengage the locking arm 260, the cam wedge 275 must be drawn to the right against the bias of the spring 285. As the cam wedge 275 is drawn to the right, the back surface 292 of the locking arm 260 rides down the canted upper surface 280 of the cam wedge 275, permitting the locking arm 260 to disengage from the rack 205. The cam wedge rods 282 are drawn to the right against the bias of spring 285 by a lever arm 295 pivoting about a pin 300. A distal end 305 of the lever arm 295, concealed within housing 307, is engaged by a cable 310 for drawing the distal end 305 to the left and pivoting the lever arm 295 about the pin 300. A proximal end 312 of the lever arm 295 is shifted to the right and bears against snap rings 314, drawing the cam wedge rods 282 and the cam wedge 275 to the right. With the locking arm 260 disengaged from the rack 205, the upright assembly 55 is free to translate longitudinally on the abductor 20.

Figure 10:
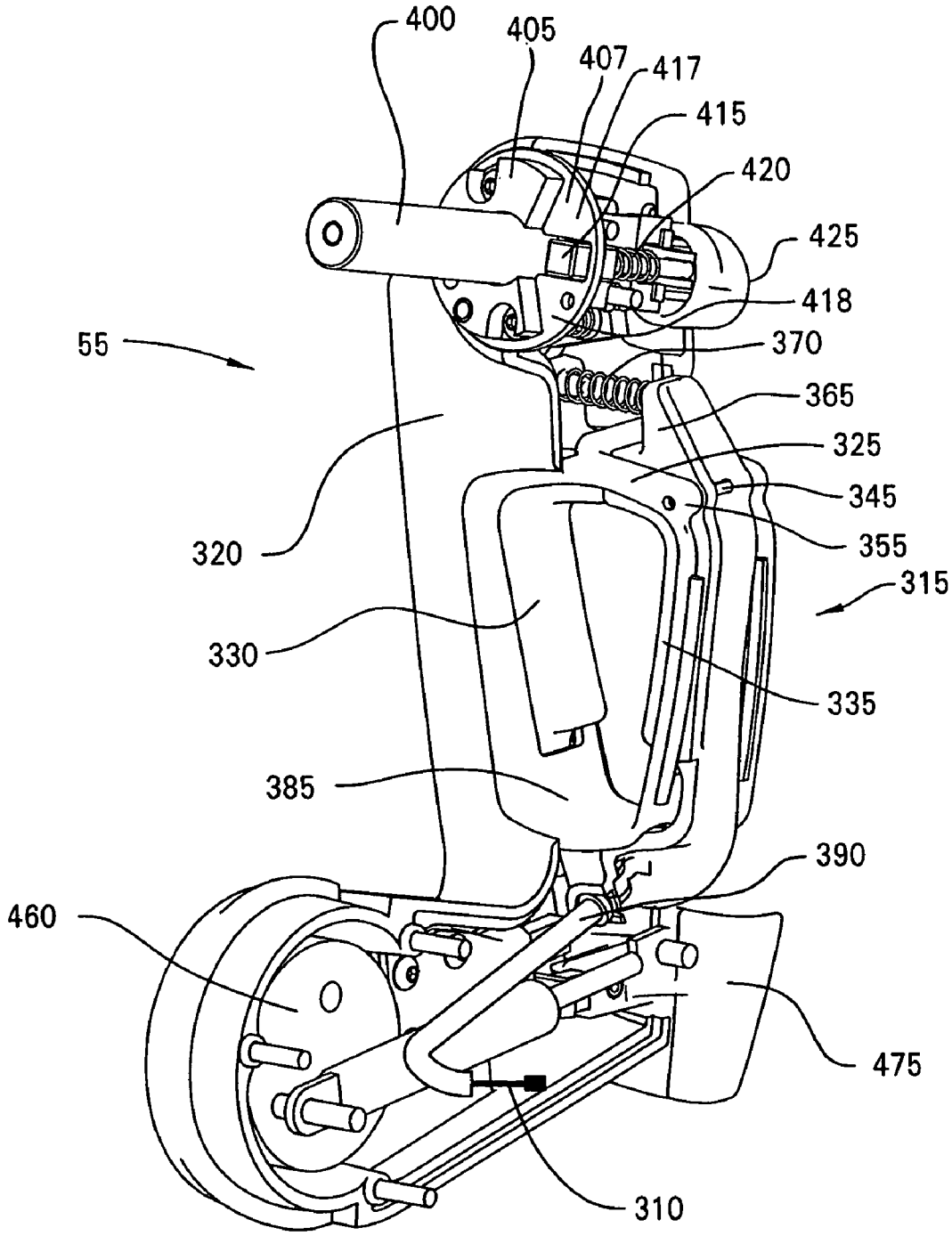
FIG. 10 is a partial cut-away perspective view of an upright assembly for the foot support of FIGS. 1-9.
Figure 11:
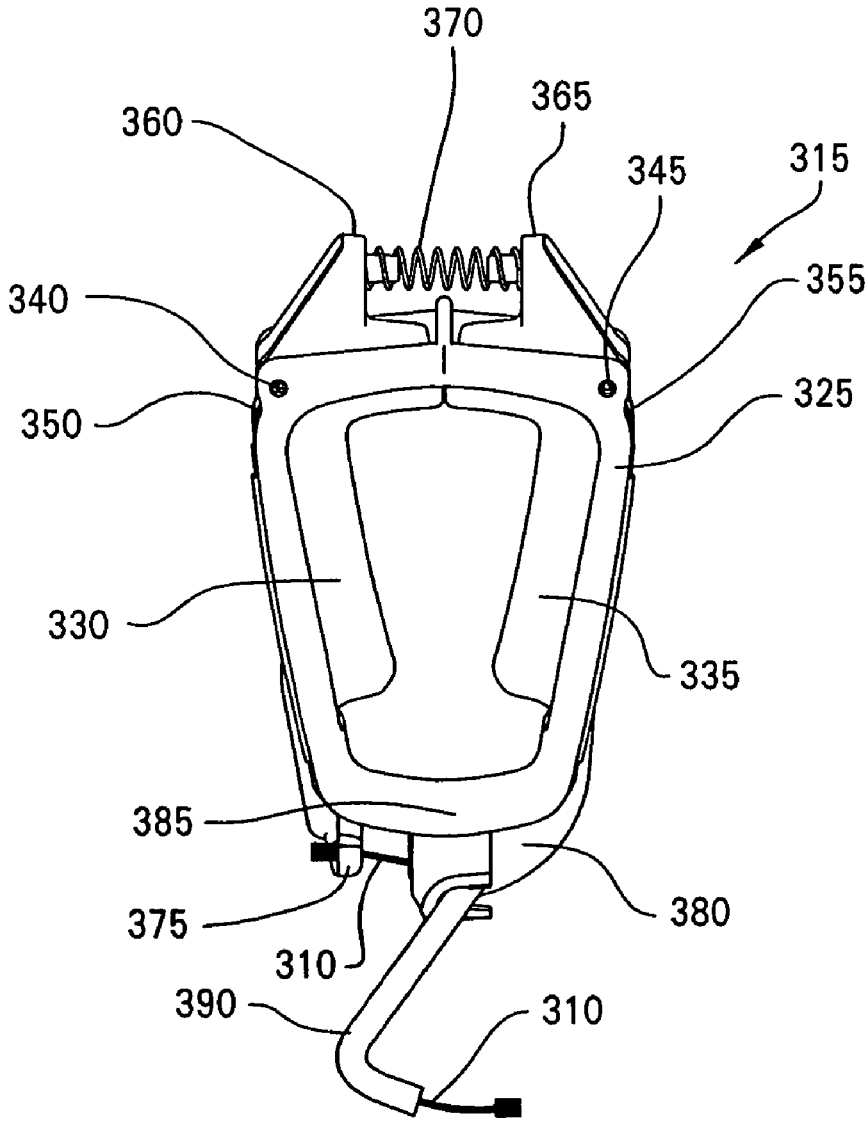
FIG. 11 is a partial cut-away side view of a handle of the upright assembly of FIG. 10.

Referring now to FIGS. 10-11, the cable 310 is actuated by a handle assembly 315 received in the housing 320 of the upright assembly 55. The handle assembly 315 includes an oblong frame 325 having a first handle 330 and a second handle 335 each pivotally attached by a pin 340, 345 to a respective upper corner 350, 355 of the oblong frame 325. Upper lever portions 360, 365 of the first and second handles 330, 335 are urged apart by a compression spring 370. This urges a lower lever portion 375 of the first handle 330 and a lower lever portion 380 of the second handle 335 together at a lower extent 385 of the frame 325. An end of the cable 310 is secured to the lower lever portion 375 of the first handle 330 and a sheath 390 of the cable 310 is affixed to the lower lever portion 380 of the second handle 335. As an operator squeezes either the first handle 330 or the second handle 335, the separation distance between the lower lever portion 375 of the first handle 330 and the lower lever portion 380 of the second handle 335 increases, forcing the cable 310 to be retracted within the sheath 390. As a consequence, the distal end 305 of the lever arm 295 is drawn in by the cable 310, thereby releasing the lock arm 260 to permit the longitudinal translation of the upright assembly 55 on the abductor 20.

Referring now to FIGS. 12-19, the foot support 65 is pivotally mounted on a pivot shaft 400 about the pivot axis 105 to an upper extent 402 of the upright assembly 55. The upright assembly 55 includes a projecting wedge portion 405 (See also FIG. 10) surrounding pivot shaft 400, and a corresponding gap portion 407. The foot support 65 includes a wedge portion 410 complementary to the wedge portion 405 for allowing a restricted rotation of the foot support 65 about the pivot shaft 400. The upright assembly further includes a foot support locking pin 415 extending into the region about the wedges 405, 410 and configured for locking the wedge 410 in one of two distinct positions.

Figure 13:
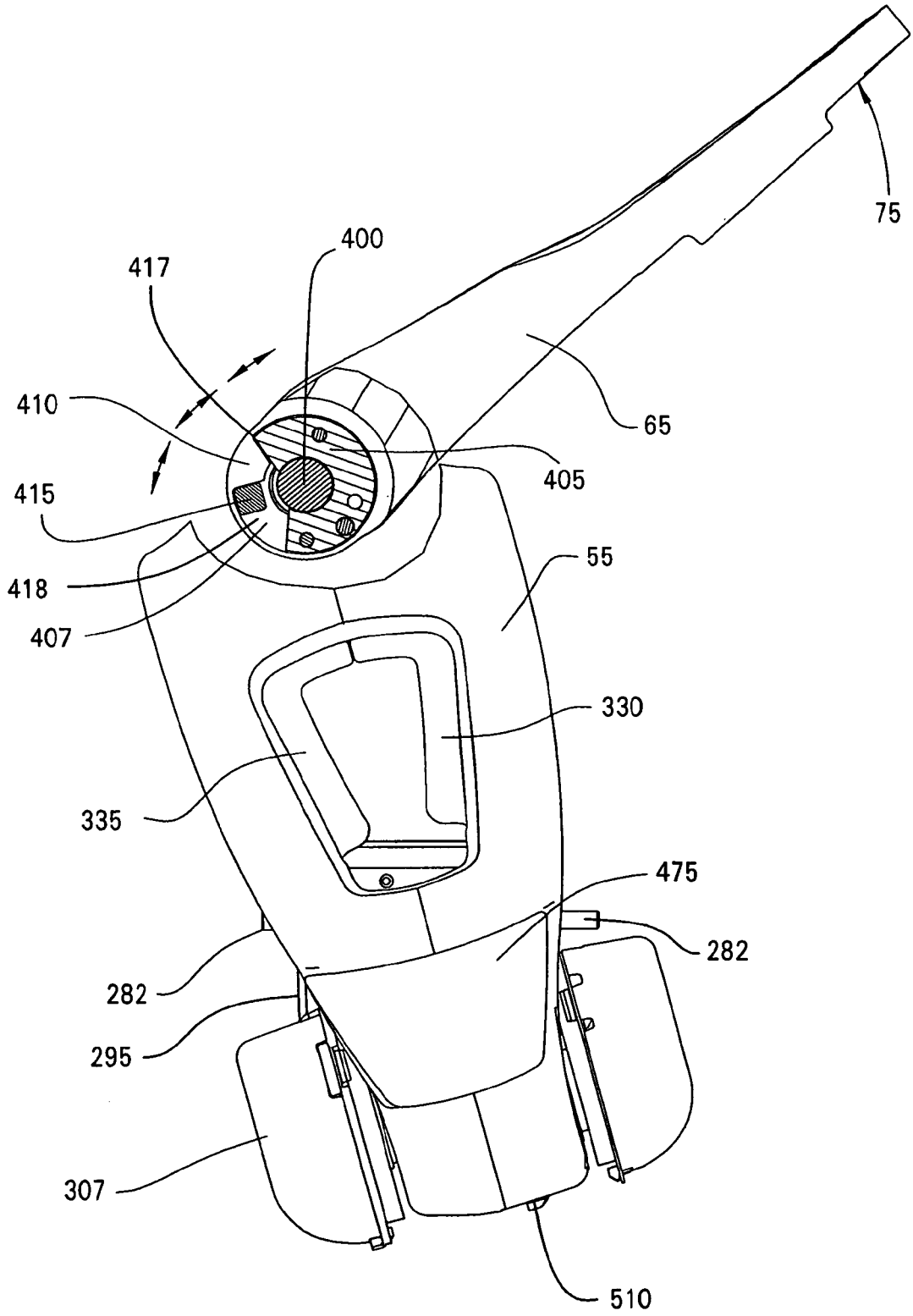
FIG. 13 is a partial cut-away side view of the upright assembly of FIGS. 10-12.
Figure 15:
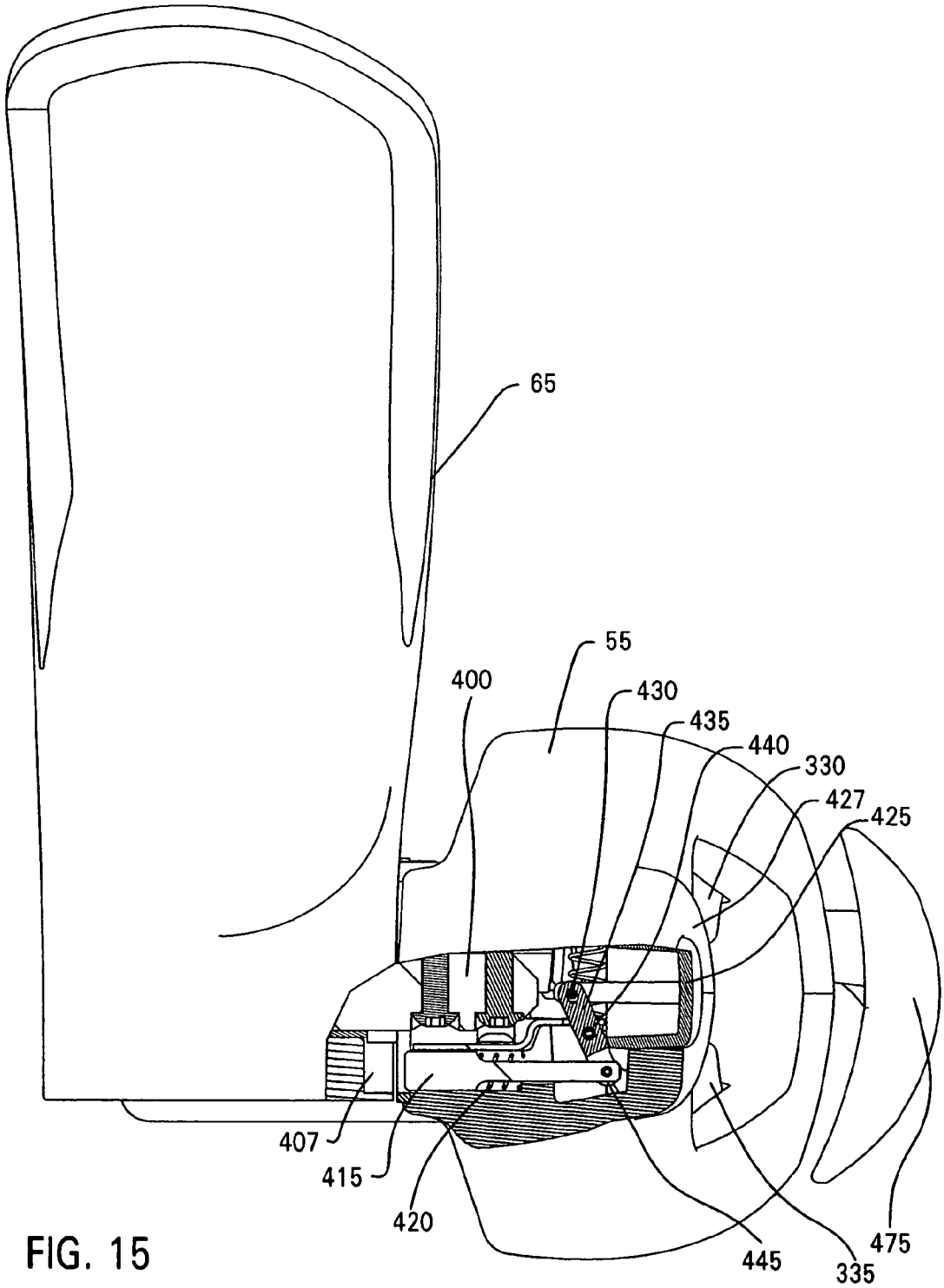
FIG. 15 is a partial cut-away plan view of the upright assembly of FIGS. 10-14 with the foot support in an unlocked position.
Figure 16:
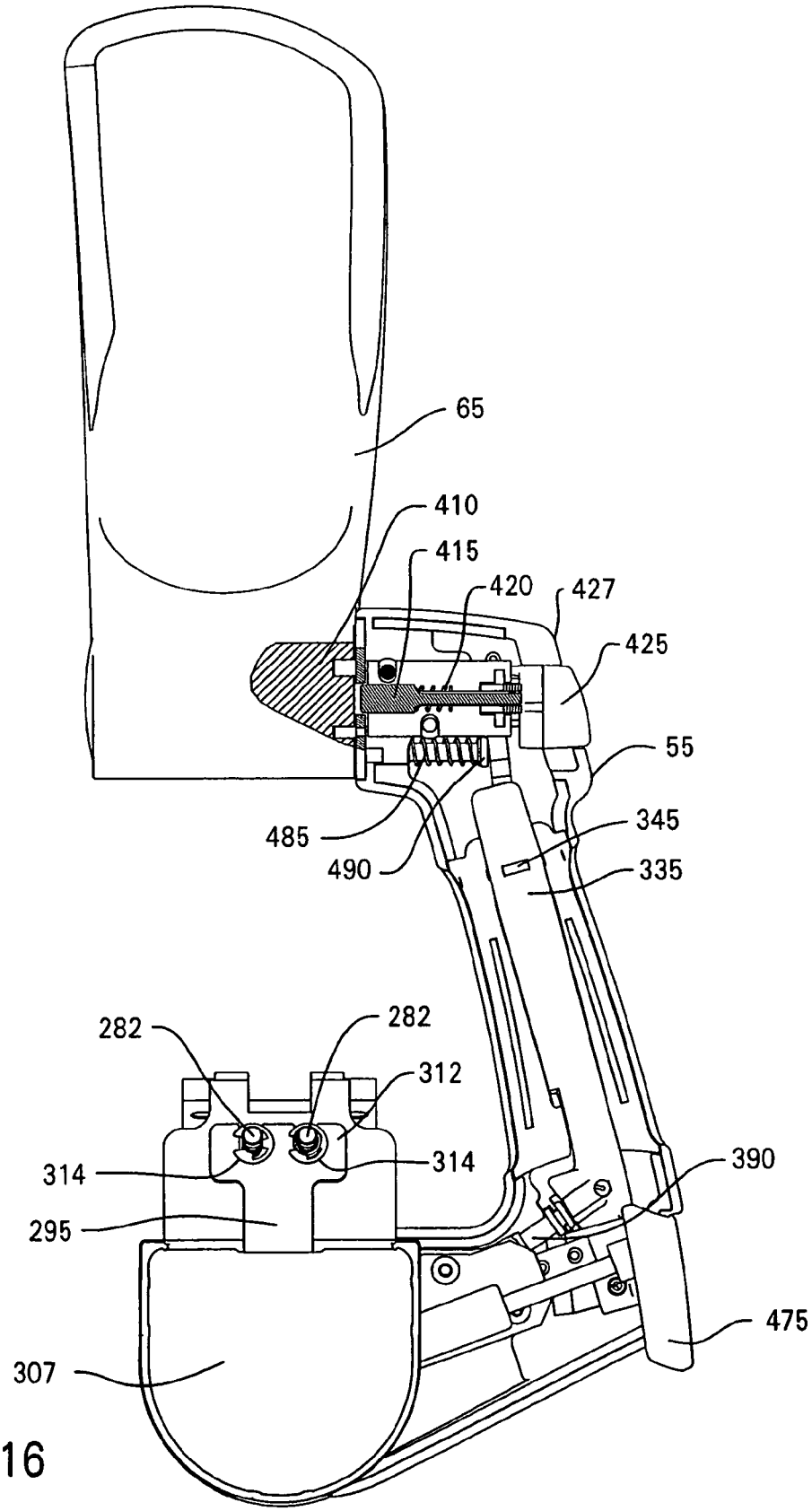
FIG. 16 is a partial cut-away end view of the upright assembly according to FIG. 15.
Figure 17:
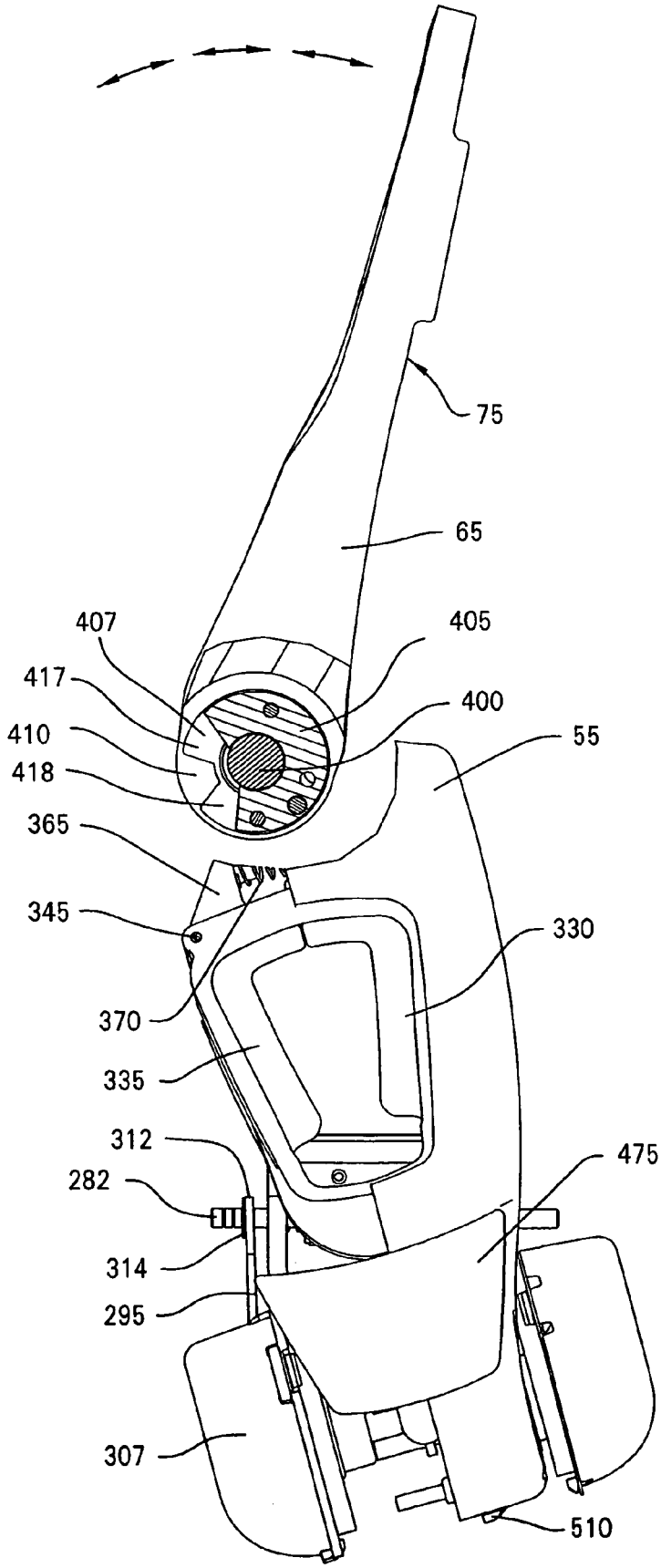
FIG. 17 is a partial cut-away side view of the upright assembly according to FIGS. 15-16.
Figure 18:
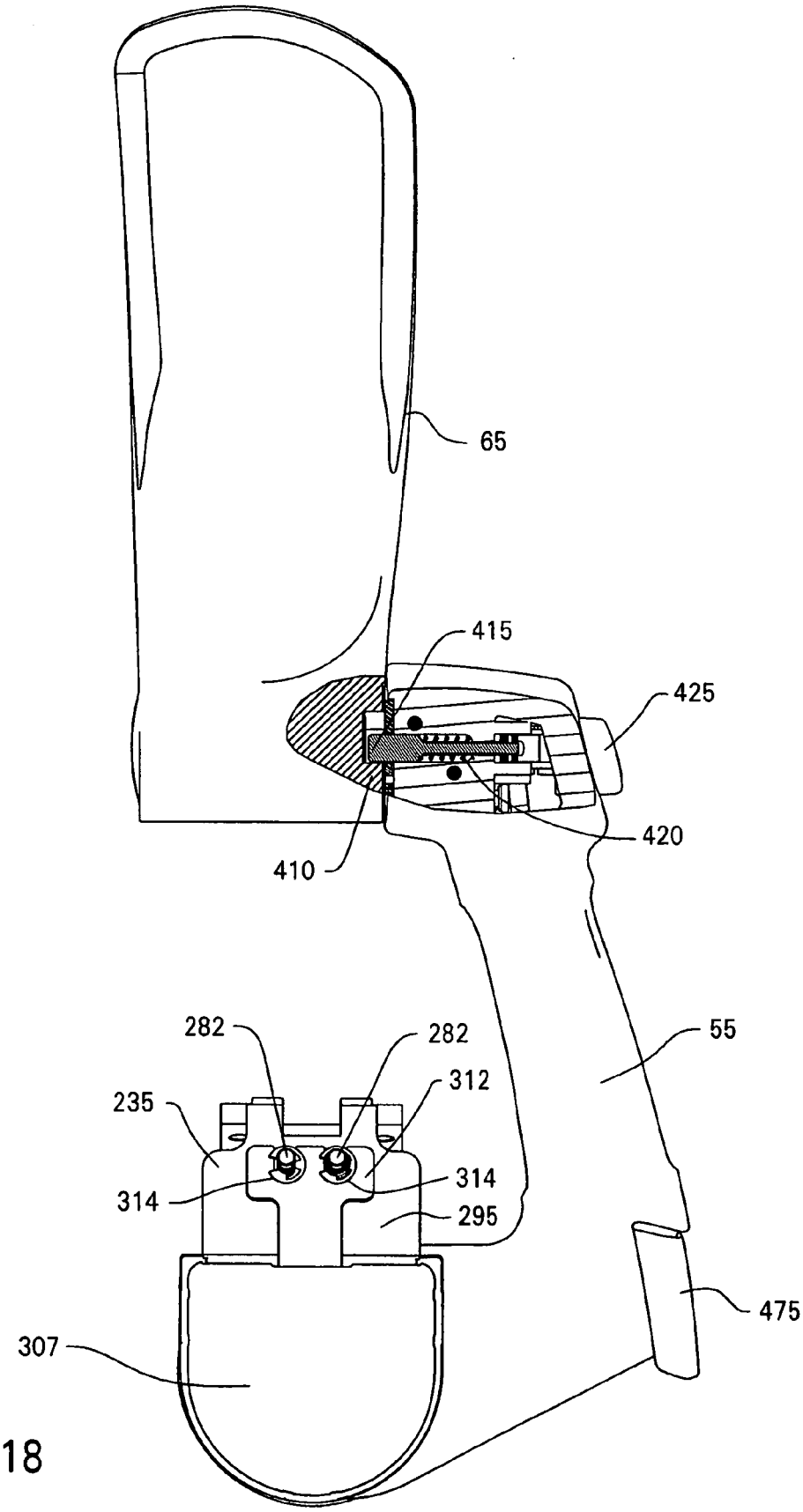
FIG. 18 is a partial cut-away end view of the upright assembly of FIGS. 10-17 with the foot support in a second deployed position.
Figure 19:
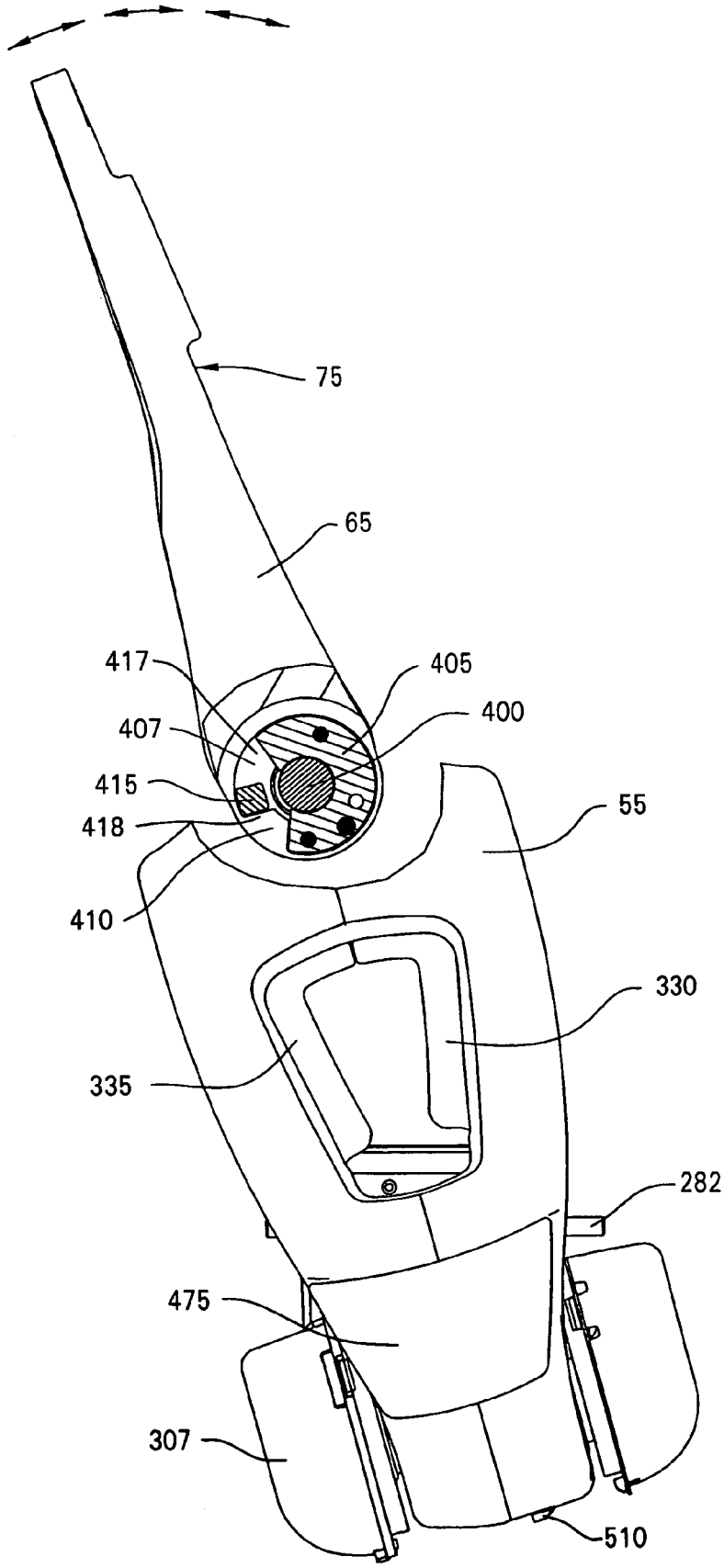
FIG. 19 is a partial cut-away side view according to FIG. 18.

In FIG. 13, the foot support 65 is locked in a foot-support-use position with the wedge portion 410 trapped in an upper extent 417 of the gap portion 407 between the wedge portion 405 and the locking pin 415. As shown in FIGS. 15-17, the pin 415 is retracted allowing the wedge 410 of the foot support to travel freely in the gap portion 407 around the wedge 405. As shown in FIG. 19, the wedge 410 is locked in a lower extent 418 of the gap portion 407 around wedge 405 by the extended foot support locking pin 415. The locking pin 415 is urged into the extended position by a spring 420. The locking pin 415 is retracted by an operator depressing a push button 425 positioned on an outer face 427 of the upright assembly 55.

Figure 14:
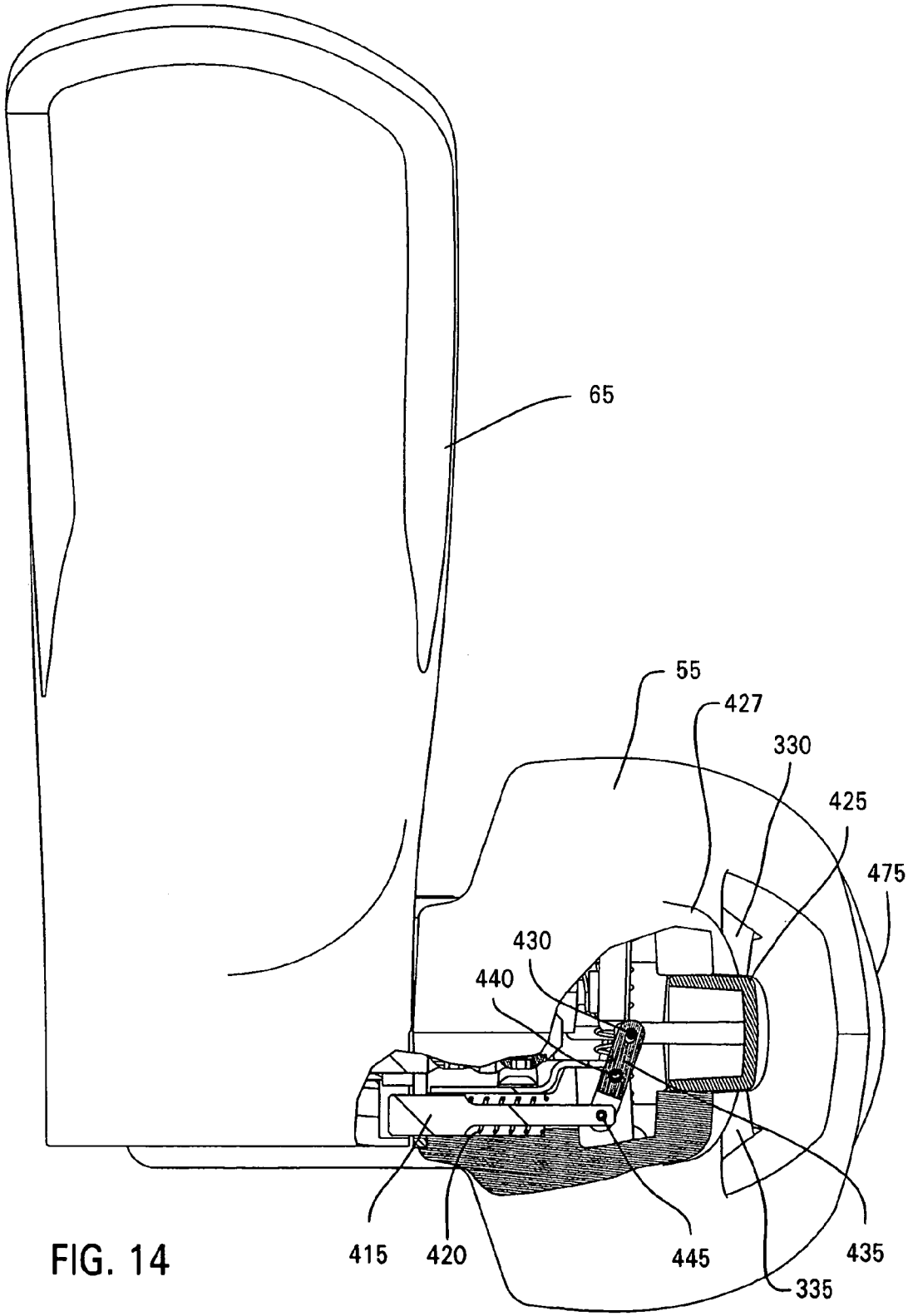
FIG. 14 is a partial cut-away plan view of the upright assembly of FIGS. 10-13 with the foot support in a locked position.

The push button 425 is pivotally connected to a first end 430 of a toggle link 435 that is pivotally mounted in the upright assembly 55 by a pivot pin 440. A second end 445 of the toggle link is pivotally connected to an end of the locking pin 415. As best illustrated in FIGS. 14-15, depressing the push button 425 forces the pin 415 to retract from engagement with the wedges 405, 410, thereby freeing the foot support 65 to rotate about the pivot axis 105.

Figure 20:
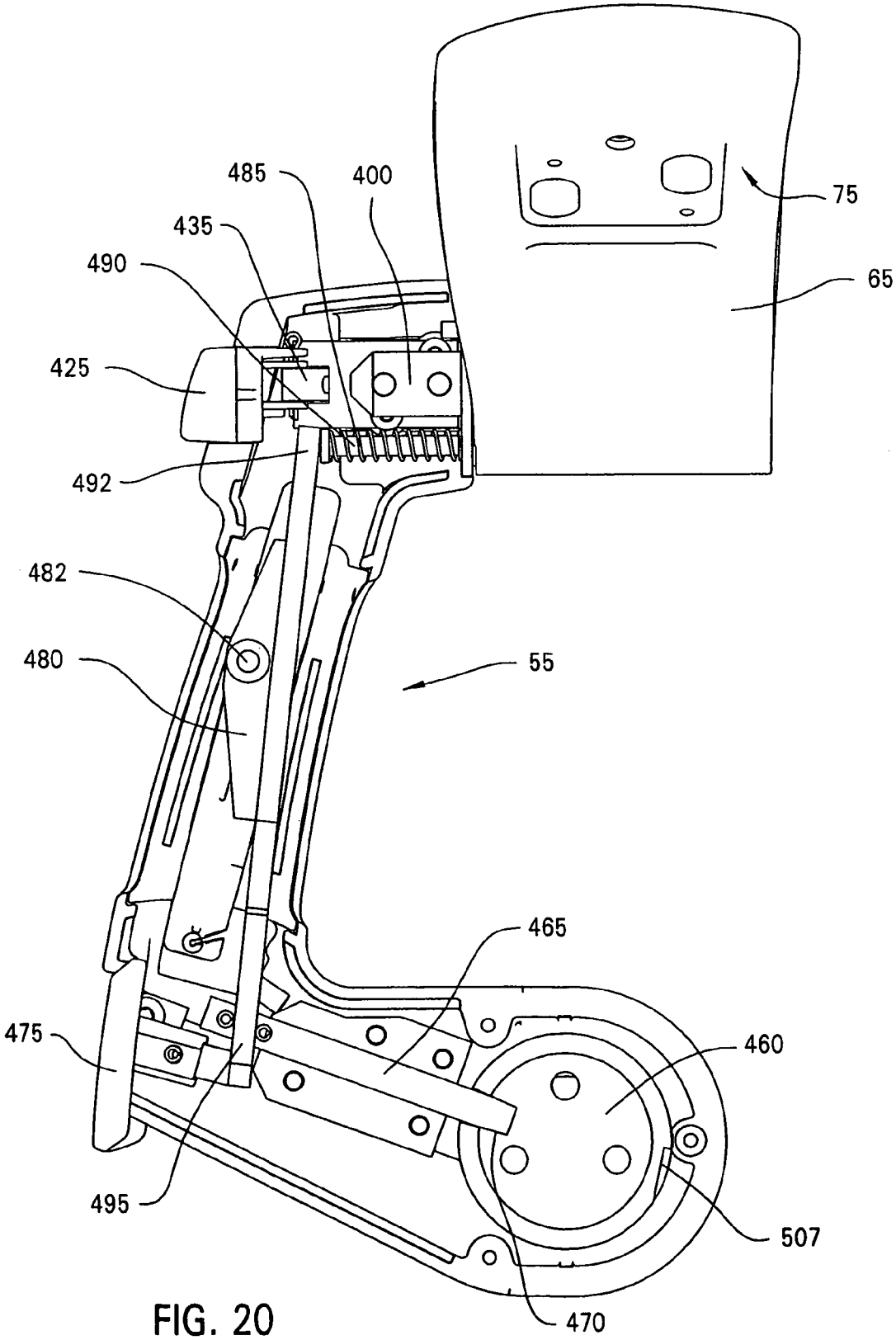
FIG. 20 is a partial cut-away end view of the upright assembly according to FIGS. 10-19 with the upright assembly in a locked position.
Figure 21:
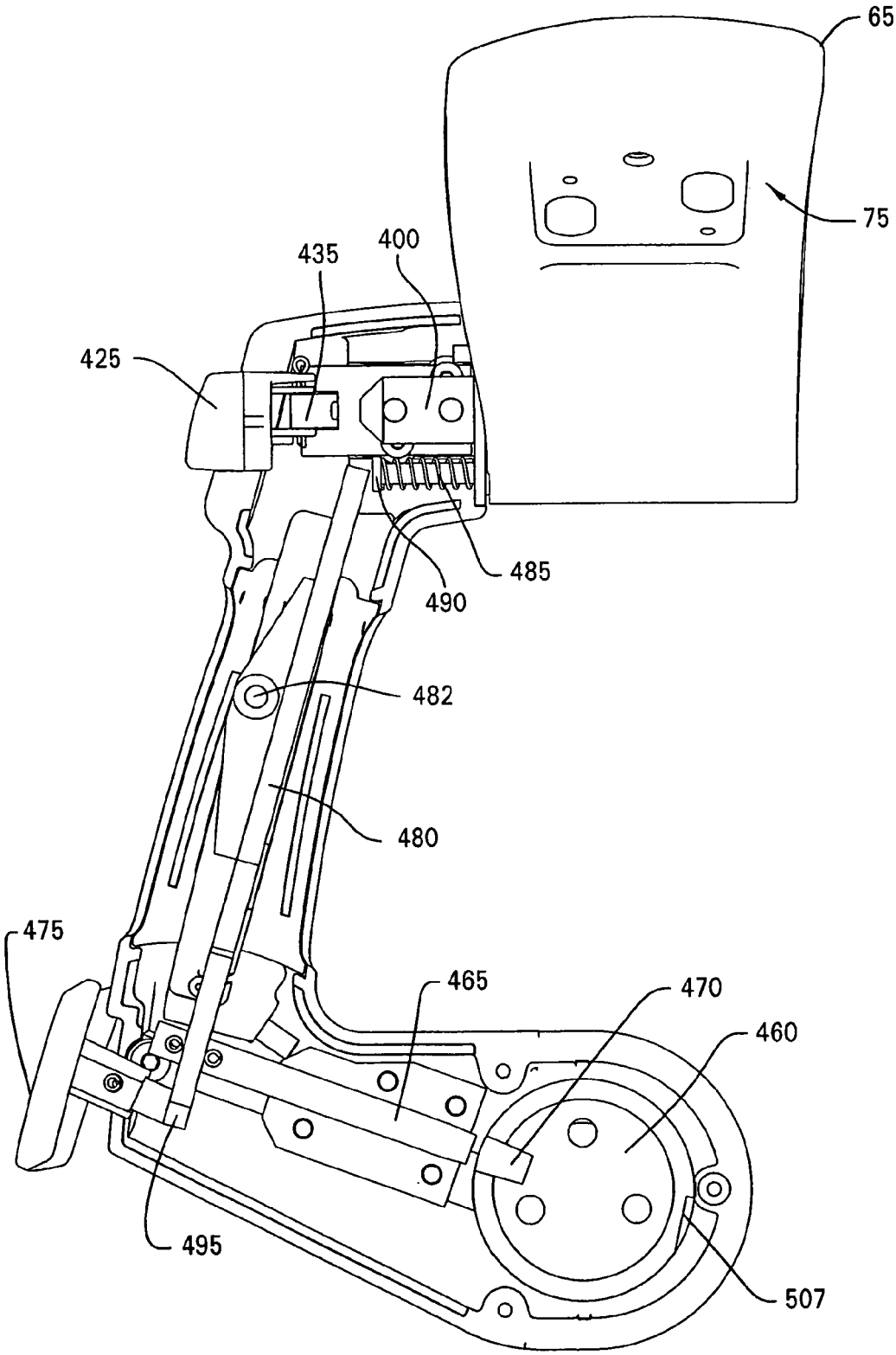
FIG. 21 is a partial cut-away end view of the upright assembly according to FIGS. 10-20 with the upright assembly in an unlocked position.
Figure 22:
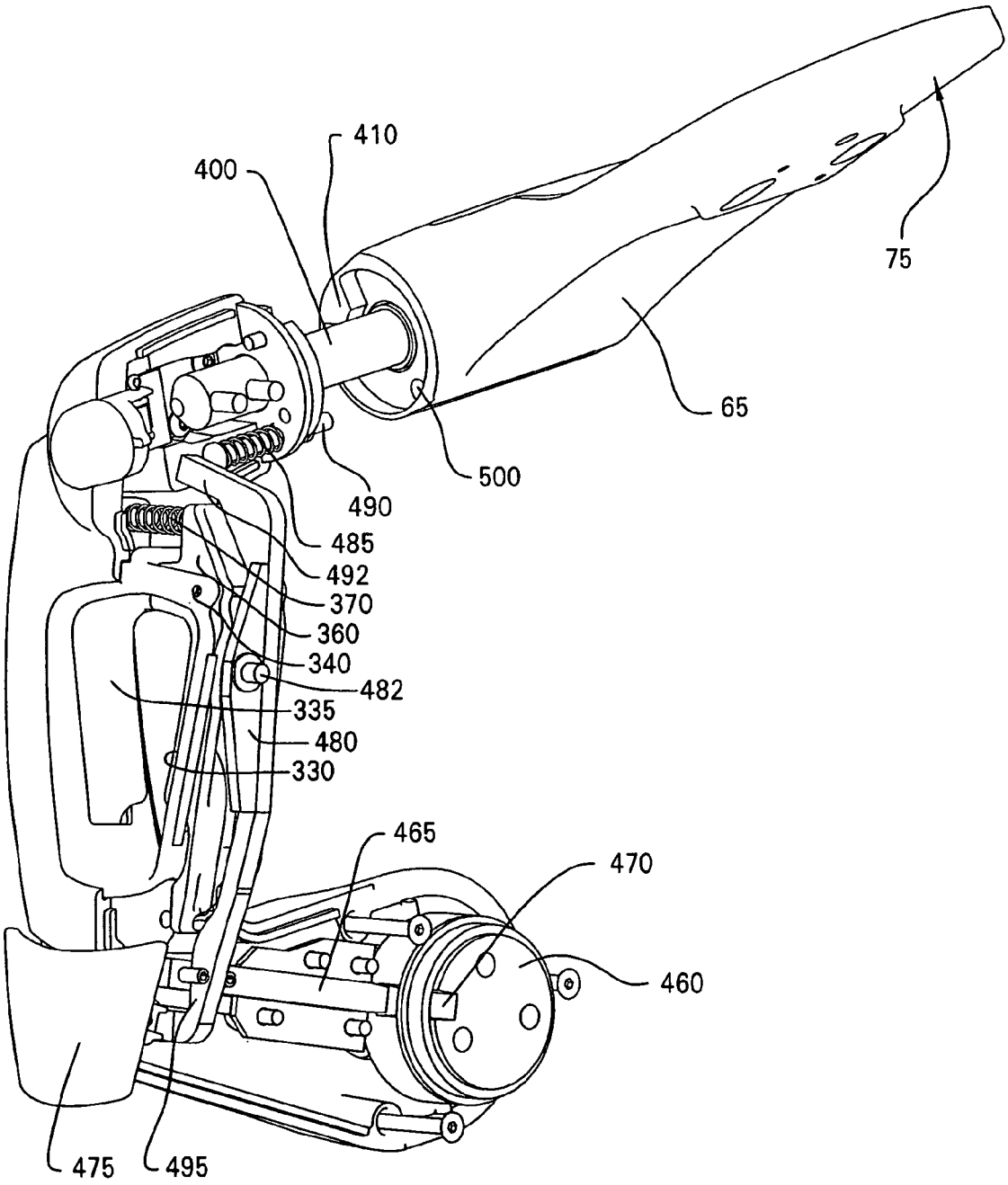
FIG. 22 is a partial cut-away perspective view of the upright assembly according to FIG. 21.

Referring now to FIGS. 20-22, the upright assembly 55 is pivotally mounted to a hub 460 affixed to the side plates 235, 240. The upright assembly 55 is maintained in an upright position by a pin 465 slidably mounted in the upright assembly 55 being received in an aperture 470 of the hub 460. The pin 465 is retractable from the aperture 470 of the hub 460 by operation of a stow-lever handle 475 and stow link 480. The stow link 480 is urged in a counterclockwise direction about a pivot pin 482 by a spring 485 mounted on a foot rotation pin 490 urging an upper end 492 of the stow link 480 to the left. A lower end 495 of the stow link 480 thereby urges the pin 465 into the aperture 470 of the hub 460. The pin 465 is drawn from the aperture 470 by an operator pulling on the stow-lever handle 475 to shift the lower end 495 of the stow link 480 to the left.

In order for the stow lever handle 475 to draw the stow link 480 in a clockwise direction against the urging of the spring 485, the foot rotation pin 490 must be translated to the right. As shown in FIG. 22, the foot support 65 must be in a position wherein a foot rotation pin aperture 500 is in alignment with the foot rotation pin 490. The position of the foot support 65, hereinafter referred to as the stow position, is the forward position wherein the foot support 65 is accessible by the patient. With the foot rotation pin 490 in alignment with the aperture 500, the stow link 480 can rotate about the pivot pin 482, urging the foot rotation pin 490 into the aperture 500. The lower end 495 of the stow link 480 draws the pin 465 out of the aperture 470 of the hub 460. With the pin 465 extracted from the aperture 470, the upright assembly 55 is free to rotate about the hub 460. As the upright assembly 55 is rotated, the operator will release the handle 475 so that pin 465, under the urging of the spring 485, will bear against the surface of the hub 460. As the upright assembly 55 rotates approximately 180 degrees, the pin 465 will engage a recessed stop/detent 507 in the surface of the hub 460. The stop/detent 507 prevents the upright assembly 55 from over-rotating, and further resists inadvertent rotation of the upright assembly 55 toward the deployed position.

Figure 23:
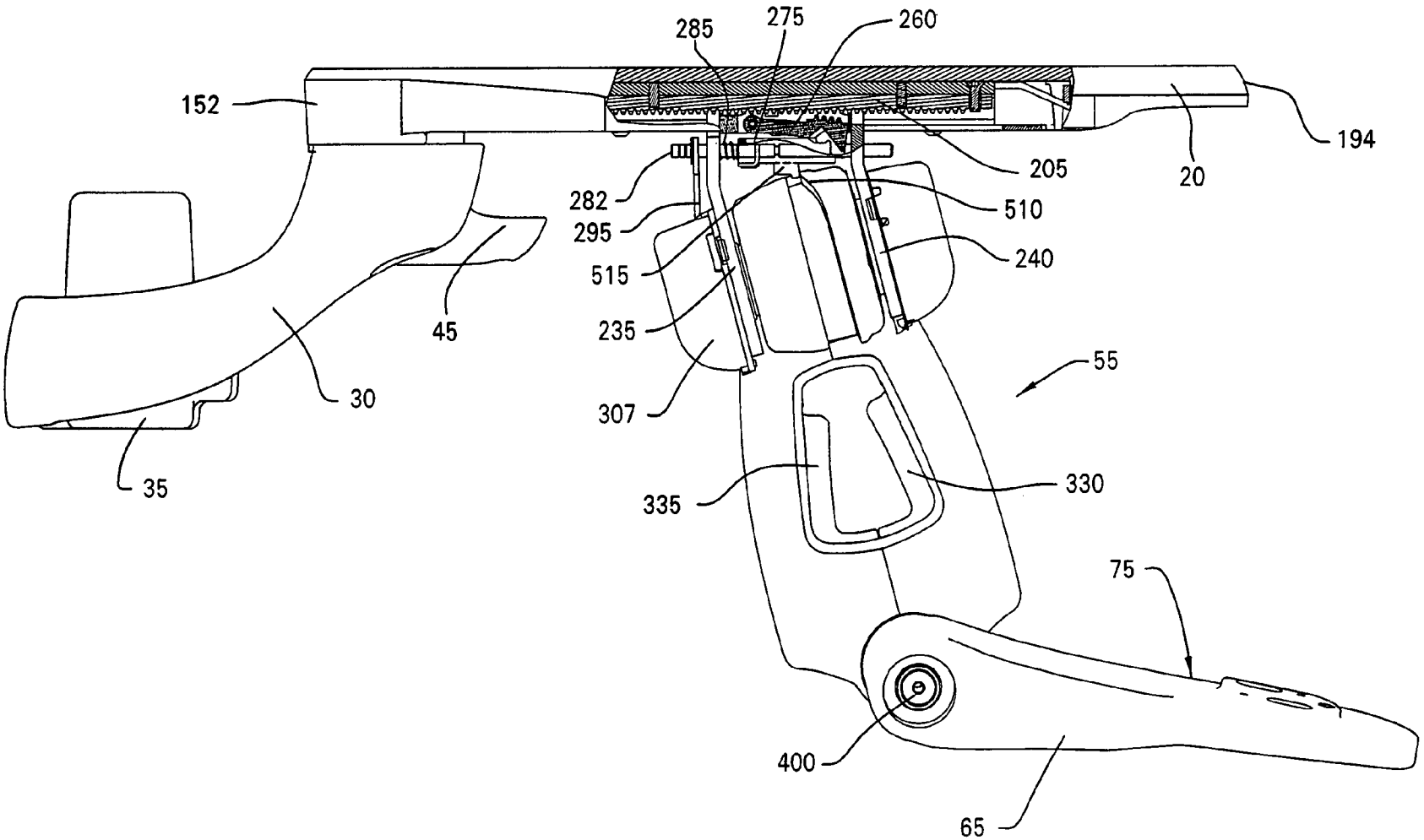
FIG. 23 is a partial cut-away side view of the abduction assembly of FIGS. 1-22 with the upright assembly in a stowed position.
Figure 24:
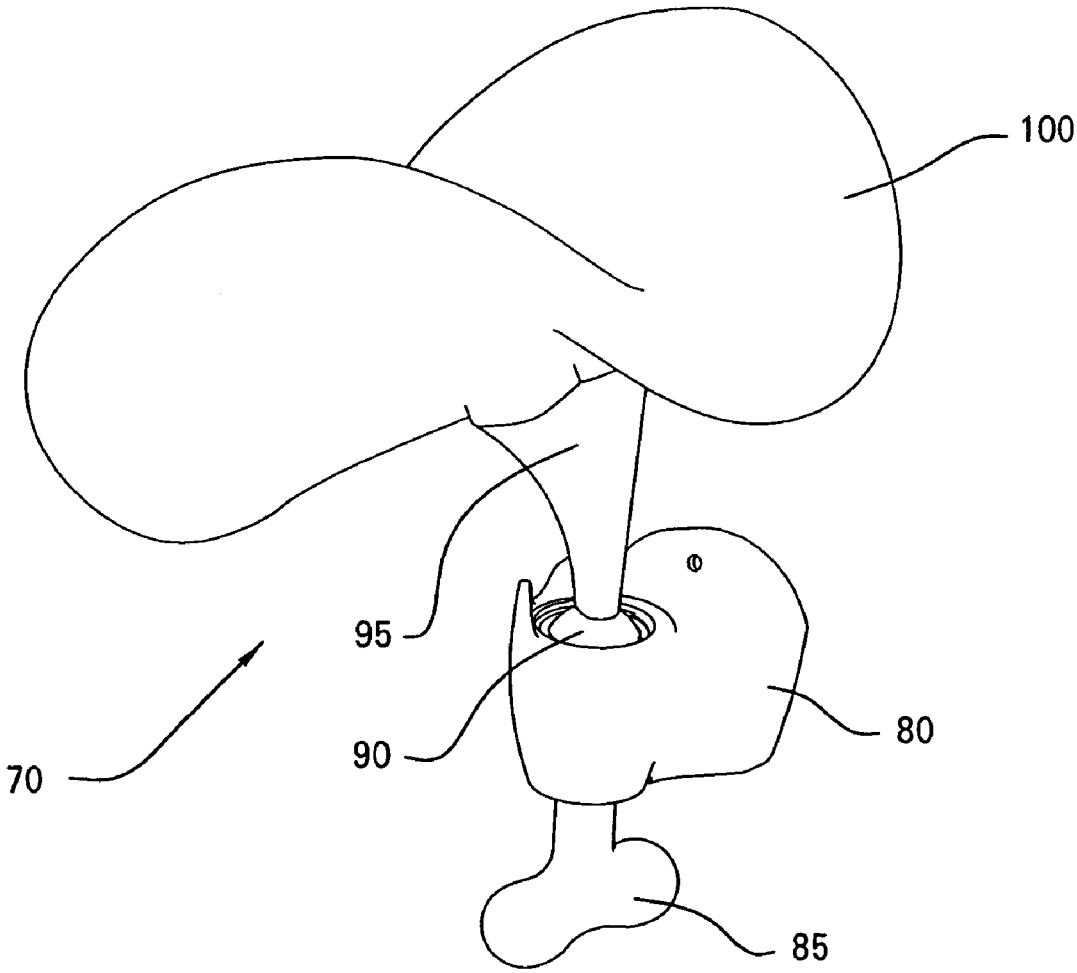
FIG. 24 is a perspective view of a calf support for attachment to the foot support of FIGS. 1-23.
Figure 25:
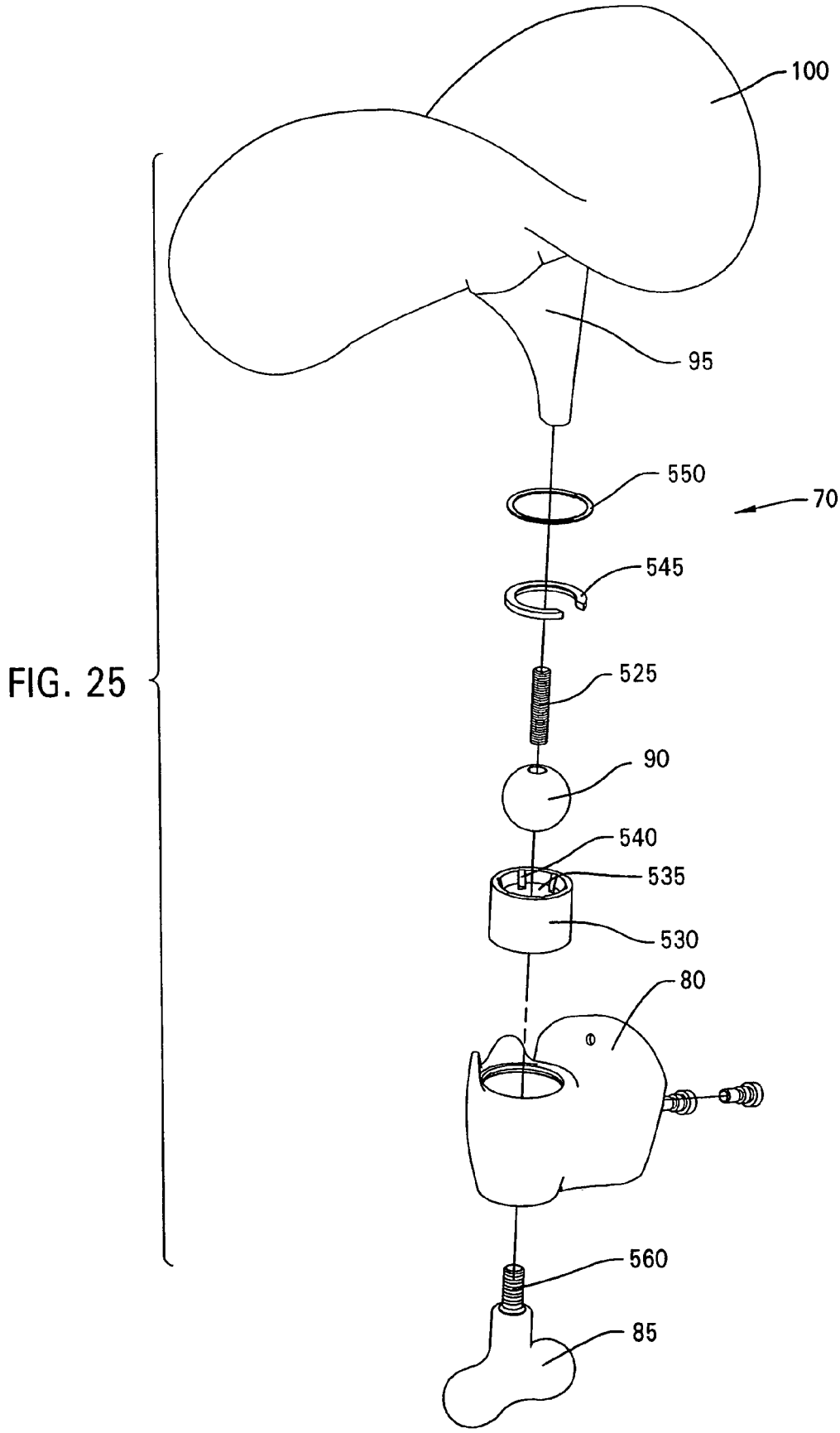
FIG. 25 is an exploded perspective view of the calf support of FIG. 24.

Referring to FIG. 23, the upright assembly 55 is rotated to a stowed position underneath the abductor 20. As the upright assembly 55 is rotated to the stowed position of FIG. 23, a cam feature 510 of the upright assembly 55 acts against a tab 515 projecting from the cam wedge 275. As the upright assembly 55 is rotated to the stowed position, the cam feature 510 rides against the tab 515 on the cam wedge 275 and forces the cam wedge 275 against the bias of the spring 285, allowing the locking arm 260 to disengage from the rack 205. The upright assembly 55 is thereby released for longitudinal movement on the rack 205 automatically when the upright assembly 55 is placed in the stowed position underneath the abductor 20.

The calf support assembly 70 is illustrated in FIGS. 24-27. The calf support 100 is constructed of a thermoformed insert 101 and a urethane foam over-molded cover 102. The insert 101 is secured to the stanchion 95 by a plate 103 and fastener 104. This assembly is then placed in a mold for application of the urethane foam over-molded cover 102. The cover 102 is sealed against fluids and formulated for compatibility with cleaning solutions. The stanchion 95 of the calf support 100 is secured to the phenolic ball 90 by a threaded rod 525. A sleeve 530 is slidably received in the calf support housing 80. The sleeve 530 includes a cup 535 having machined grooves 540 therein. The phenolic ball 90 is then received in the cup 535 of the sleeve 530 within the housing 80. A locking ring 545 is then placed over the phenolic ball 90 and a retaining ring 530 is inserted into a groove 555 in the housing 80 to retain the assembly in the housing 80. The handle 85 includes a threaded portion 560 that is received in a threaded aperture 565 of the housing 80.

Figure 26:
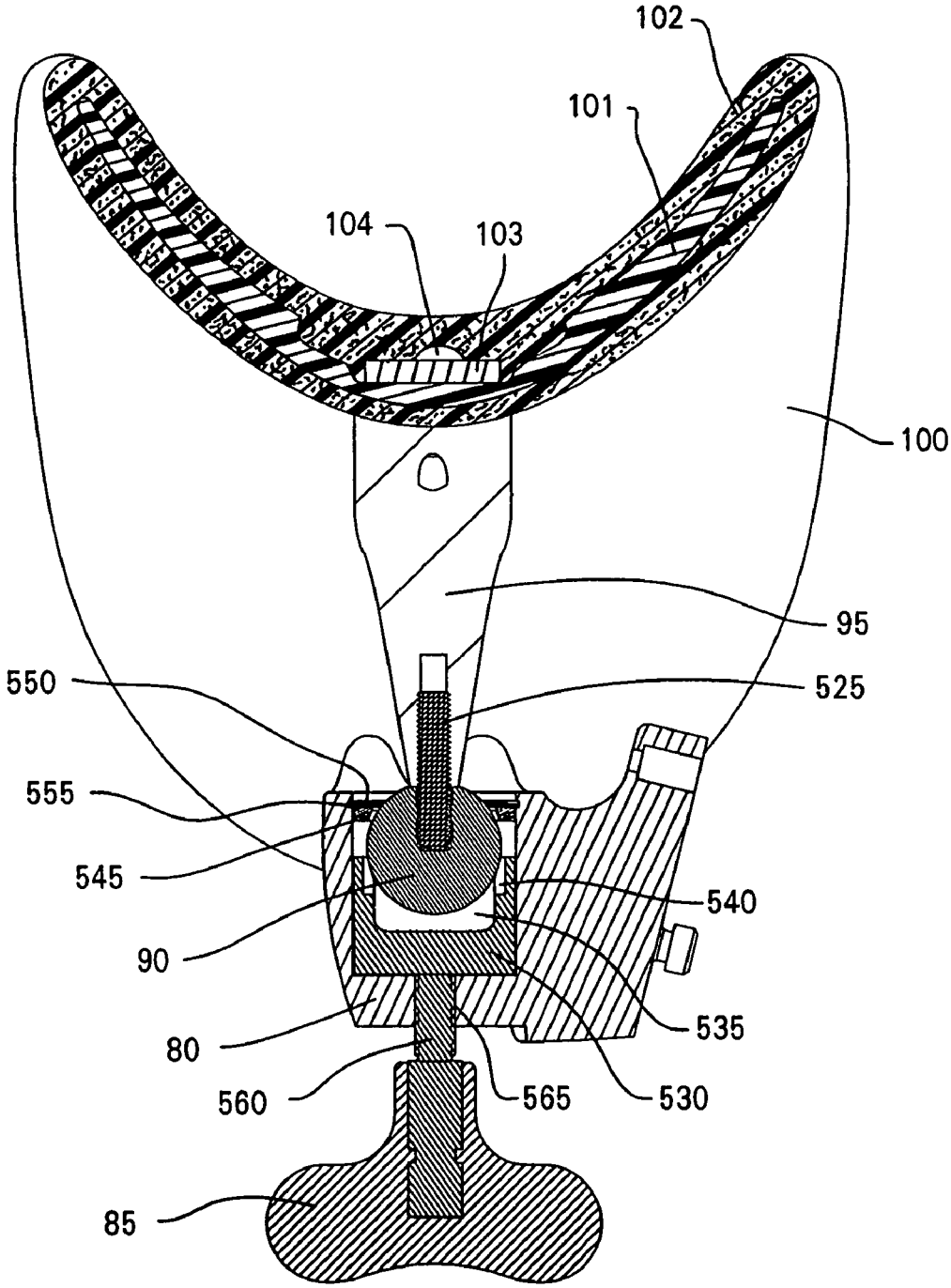
FIG. 26 is a partial cut-away end view of the calf support of FIGS. 24-25 in an unlocked position.
Figure 27:
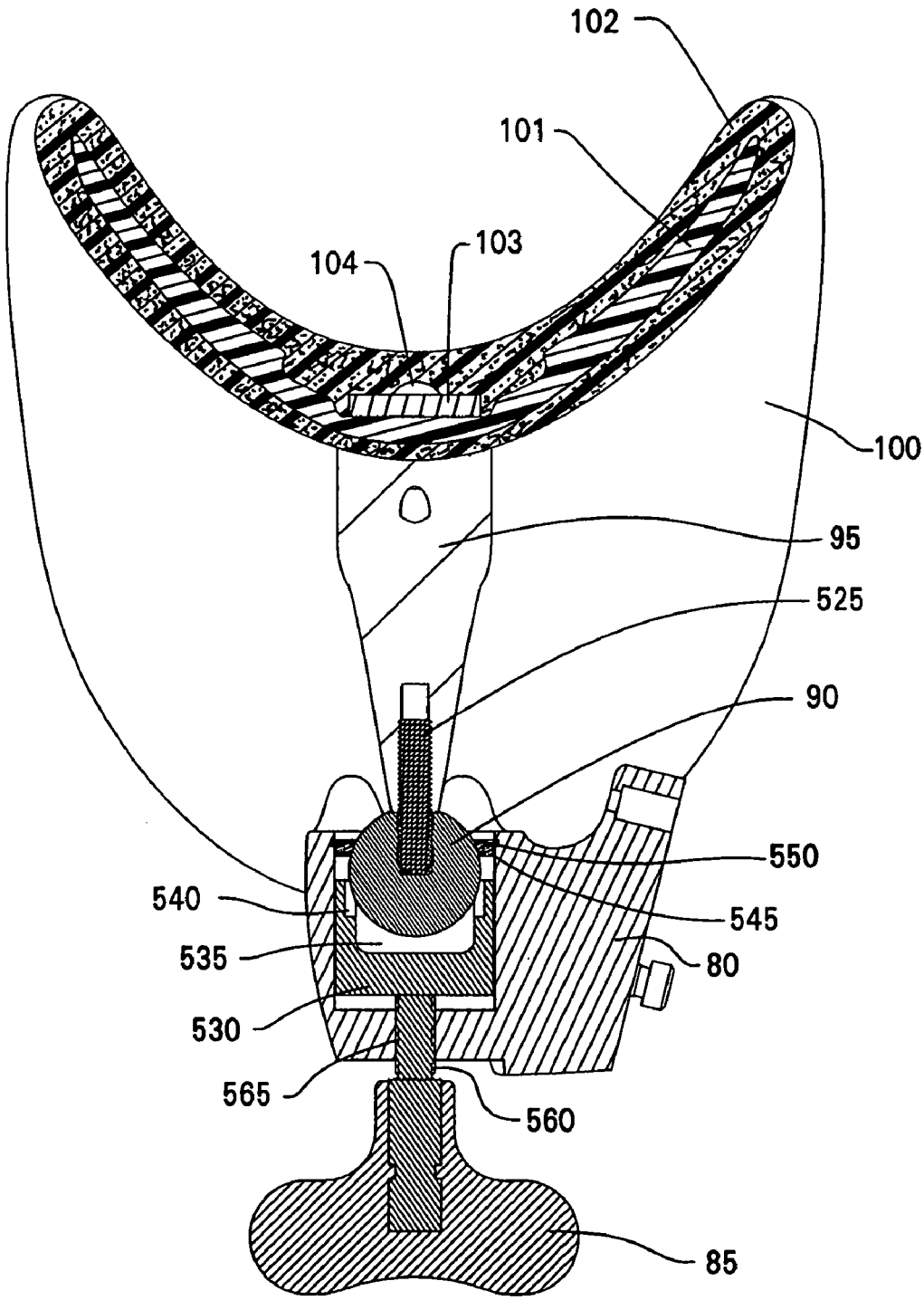
FIG. 27 is a partial cut-away end view of the calf support of FIGS. 24-26 in a locked position.

As best shown in FIGS. 26-27, the phenolic ball 90 is free to rotate or swivel within the housing 80 in FIG. 26, but as the T-locking handle 85 is threaded into the housing 80, it drives the sleeve 530 into the phenolic ball 90. The phenolic ball 90 is then locked between the sleeve 530 and the locking ring 545 to lock the calf support 100 in a fixed position.

Figure 29:
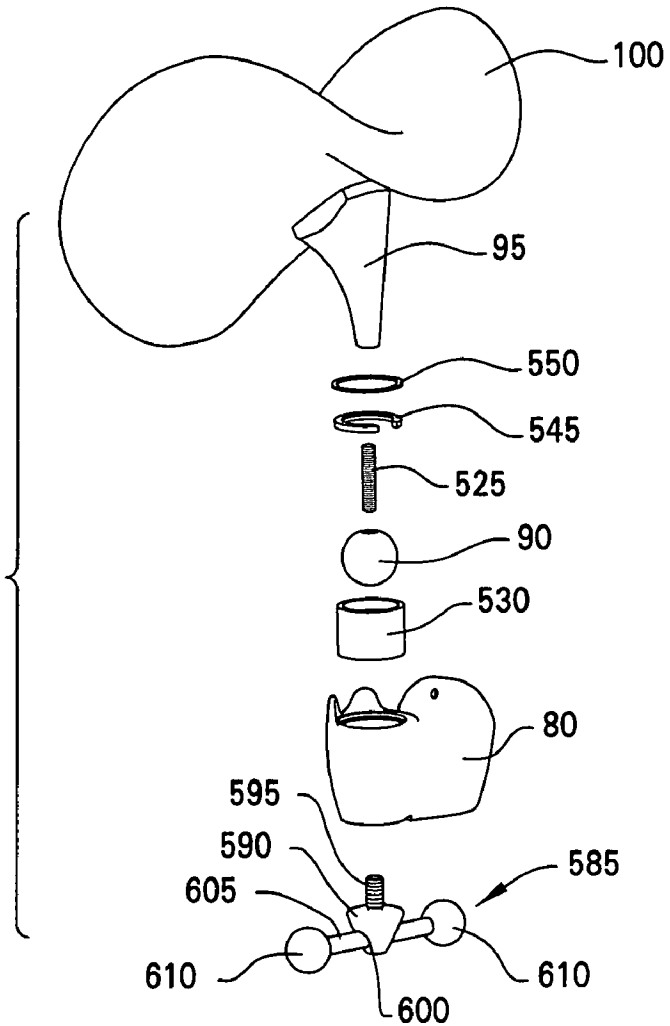
FIG. 29 is an exploded perspective view of the calf support of FIG. 28.
Figure 28:
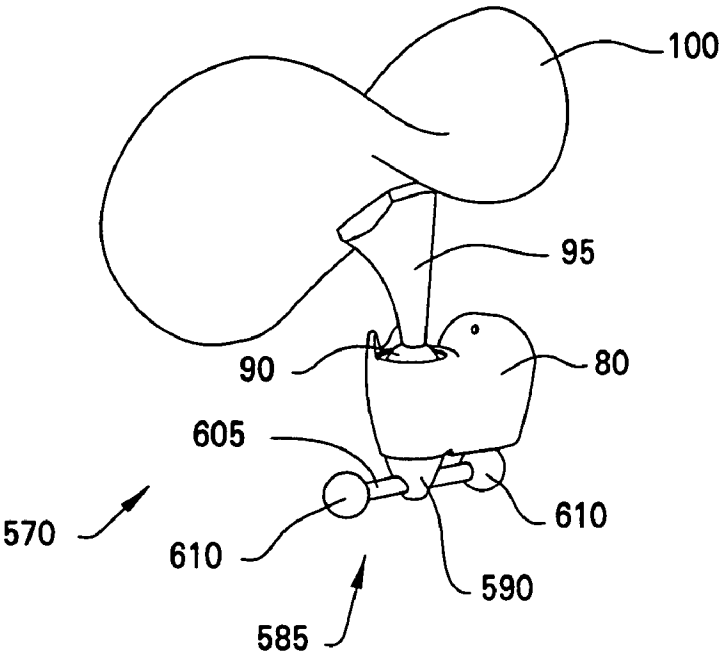
FIG. 28 is a perspective view of an alternative embodiment of a calf support for attachment to the foot support of FIGS. 1-23.
Figure 30:
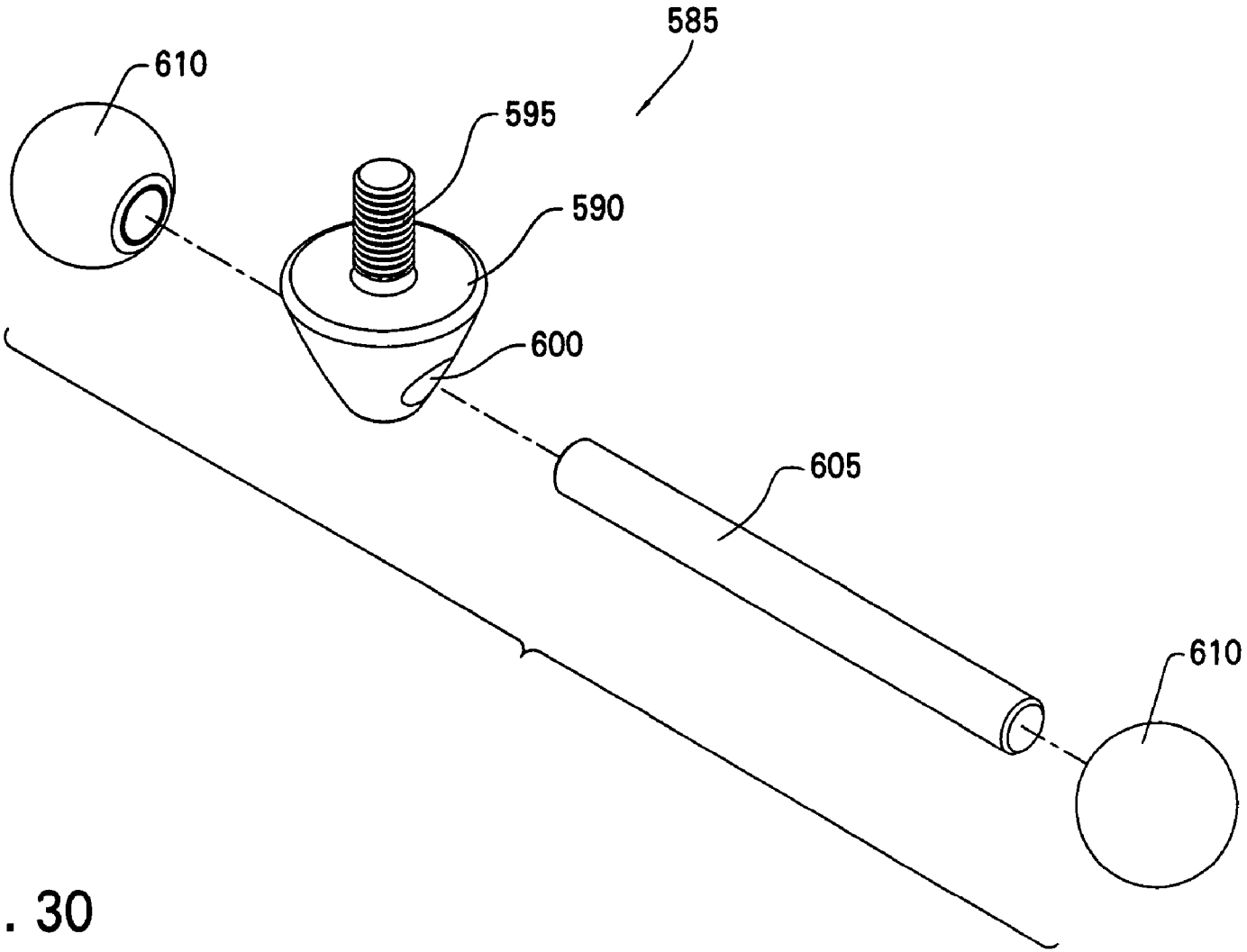
FIG. 30 is an exploded perspective view of the locking handle of the calf support of FIGS. 28-29.

Referring to FIGS. 28-30, a further embodiment of a calf support assembly 570 is illustrated. As in the embodiment of FIGS. 24-27, the stanchion 95 of the calf support 100 is secured to the phenolic ball 90 by a threaded rod 525. A sleeve 530 is slidably received in the calf support housing 80. The sleeve 530 includes a cup 535 having machined grooves 540 therein. The phenolic ball 90 is then received in the cup 535 of the sleeve 530 within the housing 80. A locking ring 545 is then placed over the phenolic ball 90 and a retaining ring 530 is inserted into a groove 555 in the housing 80 to retain the assembly in the housing 80.

A vice-type handle 585 includes a hub 590 having a threaded portion 595 extending therefrom. The threaded portion 595 is received in a threaded aperture 565 of the housing 80. The hub 590 includes a transverse aperture 600 for slidably receiving a rod 605. The rod 605 is prevented from sliding out of the aperture 600 by a pair of balls 610 mounted on each end thereof. As the handle 585 is rotated to screw the threaded portion 595 into the threaded aperture 565 of the housing 80, the rod 605 can slide through the aperture 600 of the hub 590 until one of the balls 610 abuts the hub 590. This extends the opposite end of the rod 605 from the hub 590 to create a greater available lever arm to secure the calf support 100. The sliding feature of the rod 605 also allows the handle 585 to fully rotate as the rod 605 slides through the aperture 600 to clear the back of the foot support 65 (see FIG. 2 with the T-handle 85).

Figure 31:
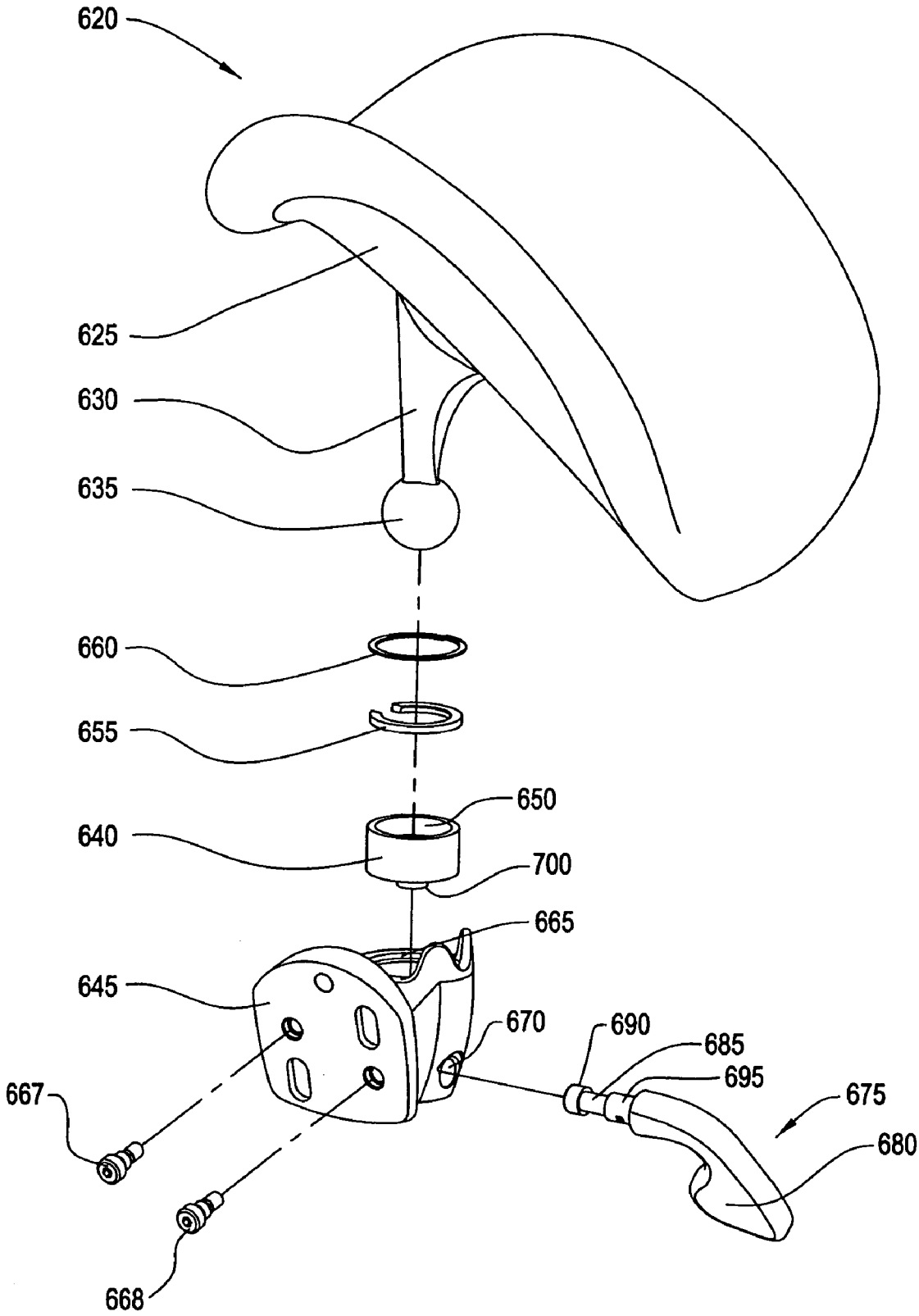
FIG. 31 is an exploded perspective view of a further embodiment of a calf support assembly for attachment to the foot support of FIGS. 1-23.
Figure 32:
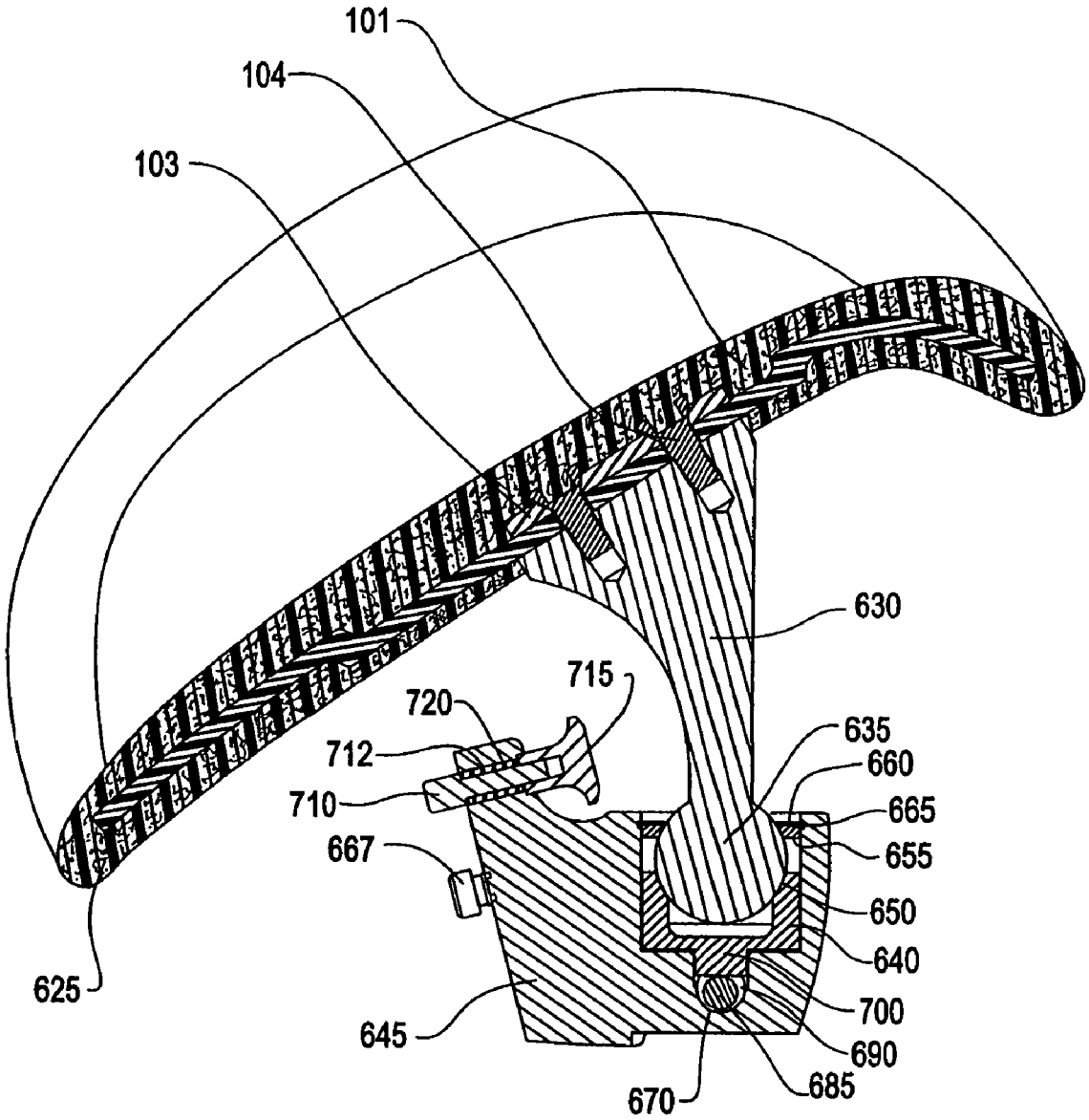
FIG. 32 is a cross-sectional view of the calf support assembly of FIG. 31 in an unlocked condition.
Figure 33:
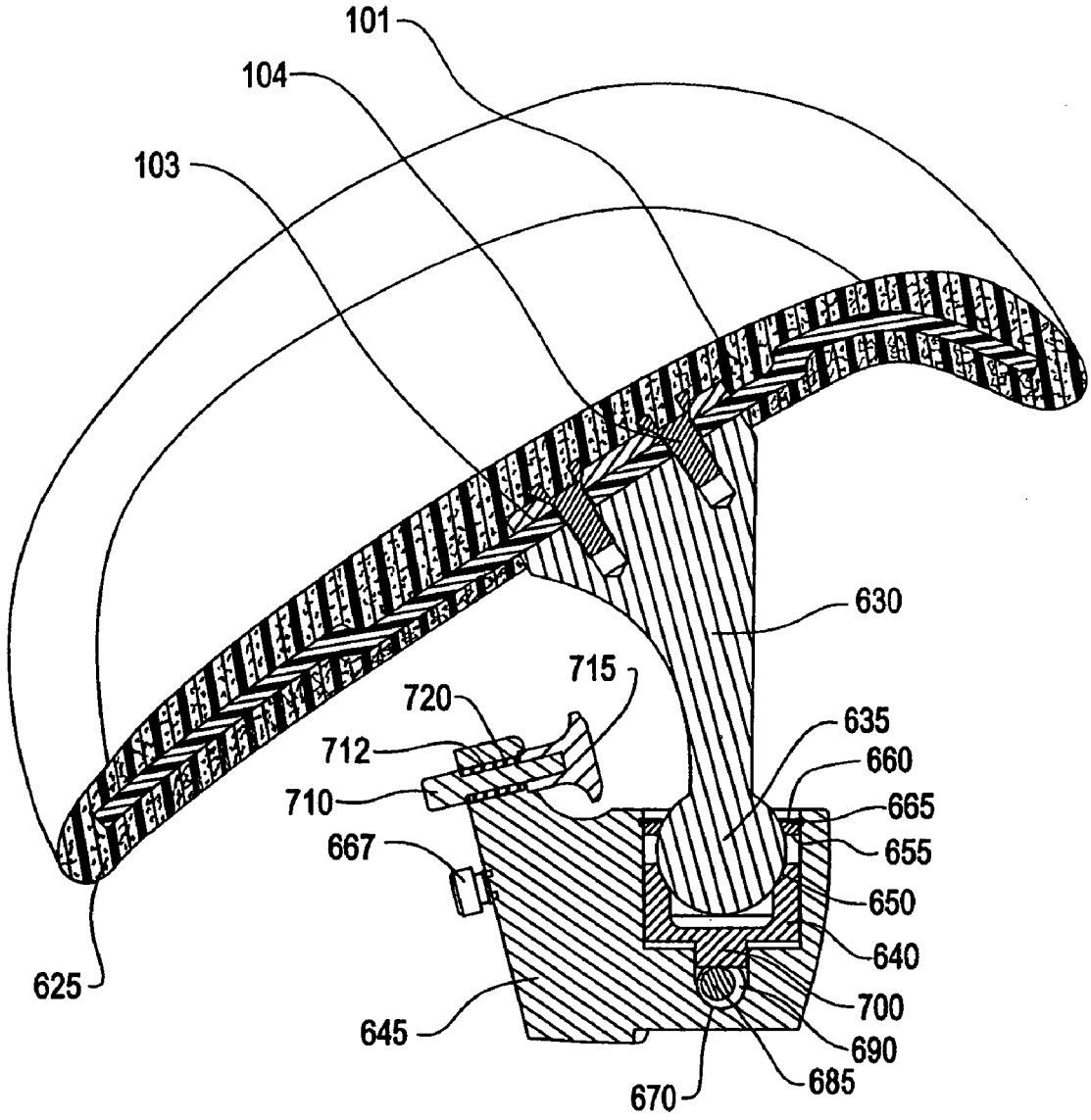
FIG. 33 is a cross-sectional view of the calf support assembly of FIGS. 31-32 in a locked condition.
Figure 35:
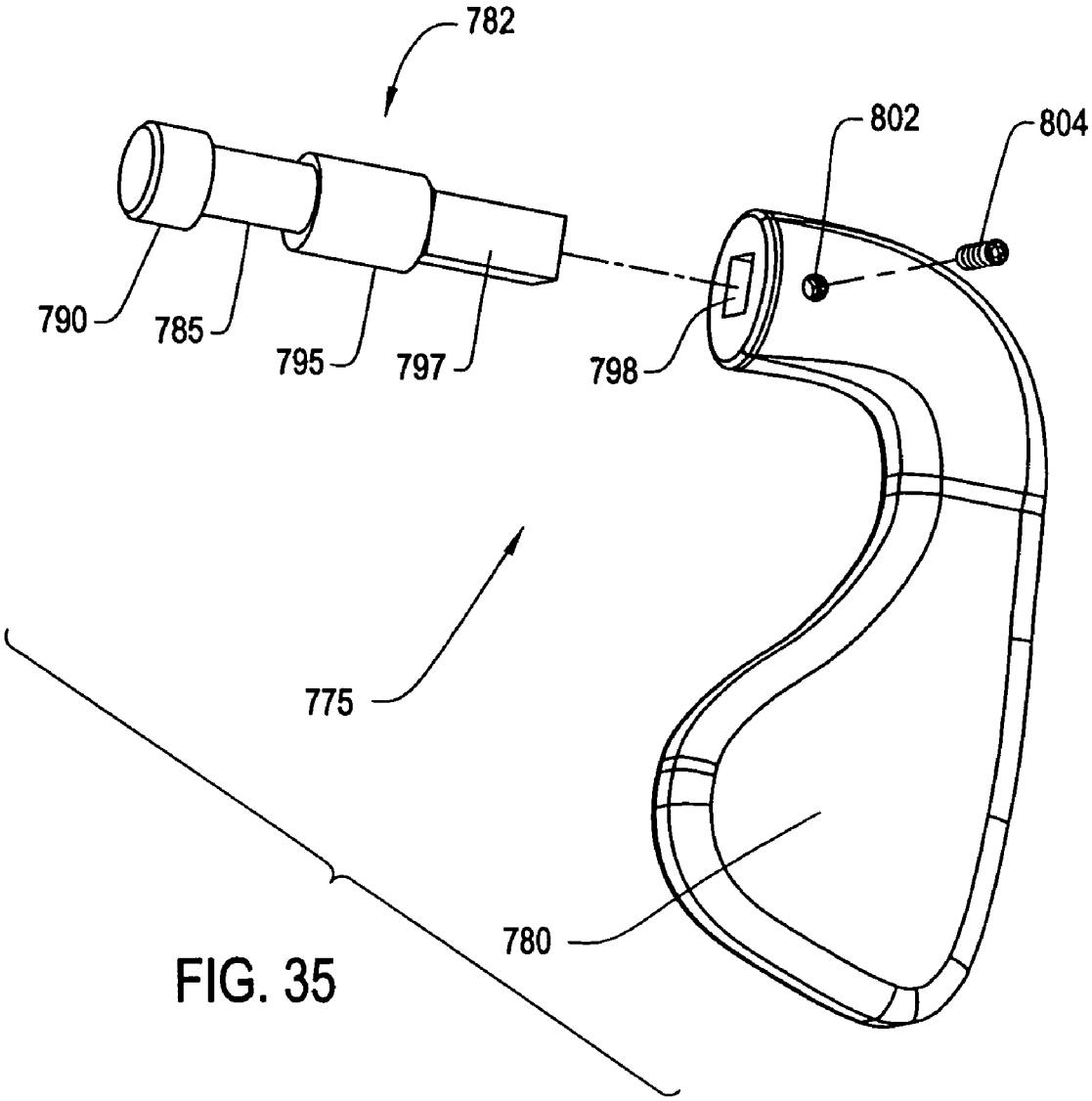
FIG. 35 is an exploded perspective view of a two-piece handle for the calf support assembly of FIGS. 31-33.
Figure 36:
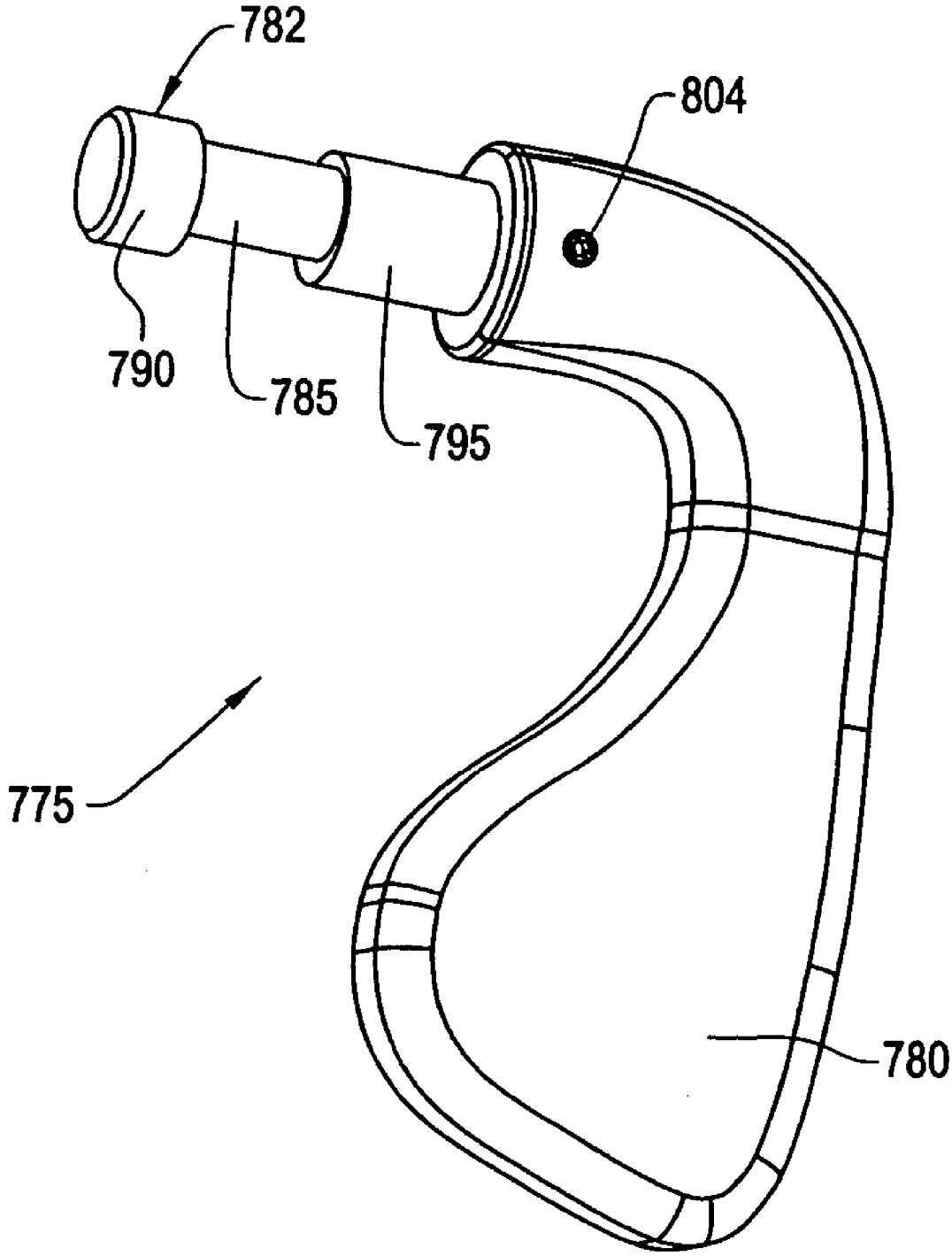
FIG. 36 is an assembled perspective view of the handle of FIG. 35.
Figure 37:
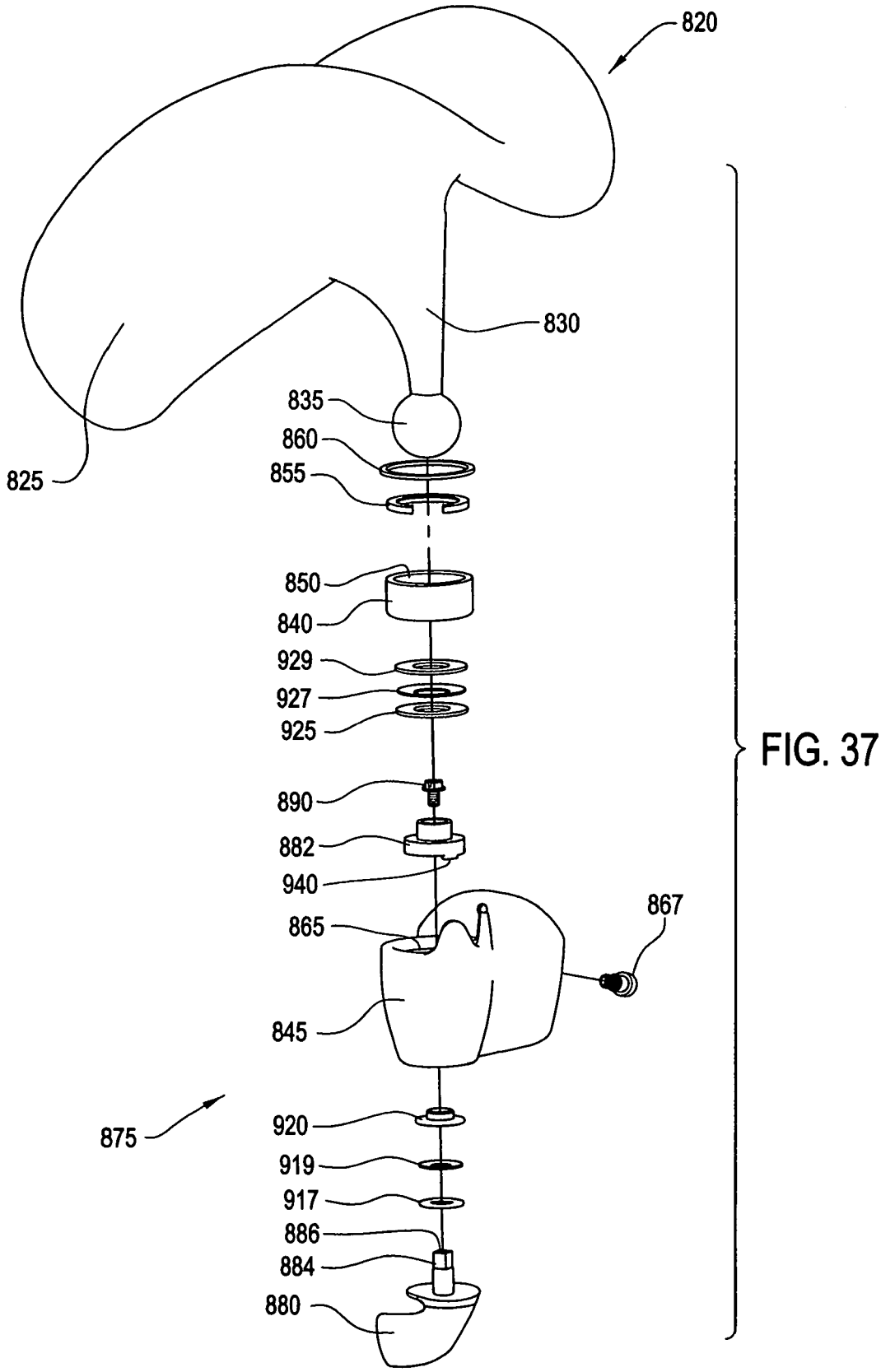
FIG. 37 is an exploded perspective view of a further embodiment of a calf support assembly for attachment to the foot support of FIGS. 1-23.

Referring to FIGS. 31-33, a further embodiment of a calf support assembly 620 is illustrated. A calf support 625 is mounted onto a stanchion 630. A phenolic ball 635 is integrally molded to the bottom of the stanchion 630. A sleeve 640 is slidably received in a calf support housing 645. The sleeve 640 includes a cup 650 configured for receiving the phenolic ball 635. A locking ring 655 is placed over the phenolic ball 635 and a retaining ring 660 is inserted into a groove 665 in the housing 645 to retain the phenolic ball 635 between the locking ring 655 and the sleeve 640. A pair of headed mounting studs 667, 668 is attached to the housing 645 for mounting the housing 645 to the foot support 65. The housing 645 further includes a cylindrical sleeve 670 for receiving a cam-lock mechanism 675. The cam-lock mechanism 675 includes a paddle-type handle 680 and a cam shaft 685 eccentrically arranged between a pair of cylindrical bearings 690, 695. The cam-lock mechanism 675 is of single piece construction. However, as shown in FIGS. 35-36, a two-piece cam-lock mechanism 775 is interchangeable with the cam-lock mechanism 675, and includes a paddle-type handle 780 and a cam insert 782. The cam insert 782 is formed having a cam shaft 785 eccentrically arranged between a pair of cylindrical bearings 790, 795. The cam insert 782 further includes a square or rectangular base shaft 797 configured for receipt in a complimentary recess 798 in the paddle-type handle 780. A threaded aperture 802 passes transversely through the paddle-type handle 780 into the recess 798. Upon insertion of the base shaft 797 into the recess 798, a set screw 804 is threaded into the threaded aperture 802 to lock the base shaft 797 within the recess 798, as shown in FIG. 36. Further reference to the placement and function of cam-lock mechanism 675 applies equally to the two-piece cam-lock mechanism 775 of FIGS. 35-36.

When the cam-lock mechanism 675 is mounted within the housing 645 as shown in FIGS. 32-33, the cylindrical bearings 690, 695 are rotatably received within the cylindrical sleeve 670, and the cam shaft 685 is centered beneath the cup 650, aligned with a centrally positioned extension 700 on the base of the sleeve 640. With the extension 700 bearing on the cam shaft 685, rotation of the cam-lock mechanism 675, such as by exertion of force on the paddle-type handle 680, selectively raises or lowers the cup 650. As shown in FIG. 32, the cam shaft 685 is rotated to a lowered position, lowering the sleeve 640 and releasing the phenolic ball 635. In FIG. 33, the cam-lock mechanism 675 has been rotated to place the cam shaft 685 in the raised position, lifting the sleeve 640 into a locked position trapping the phenolic ball 635 between the cup 650 of the sleeve 640 and the locking ring 655.

Figure 34:
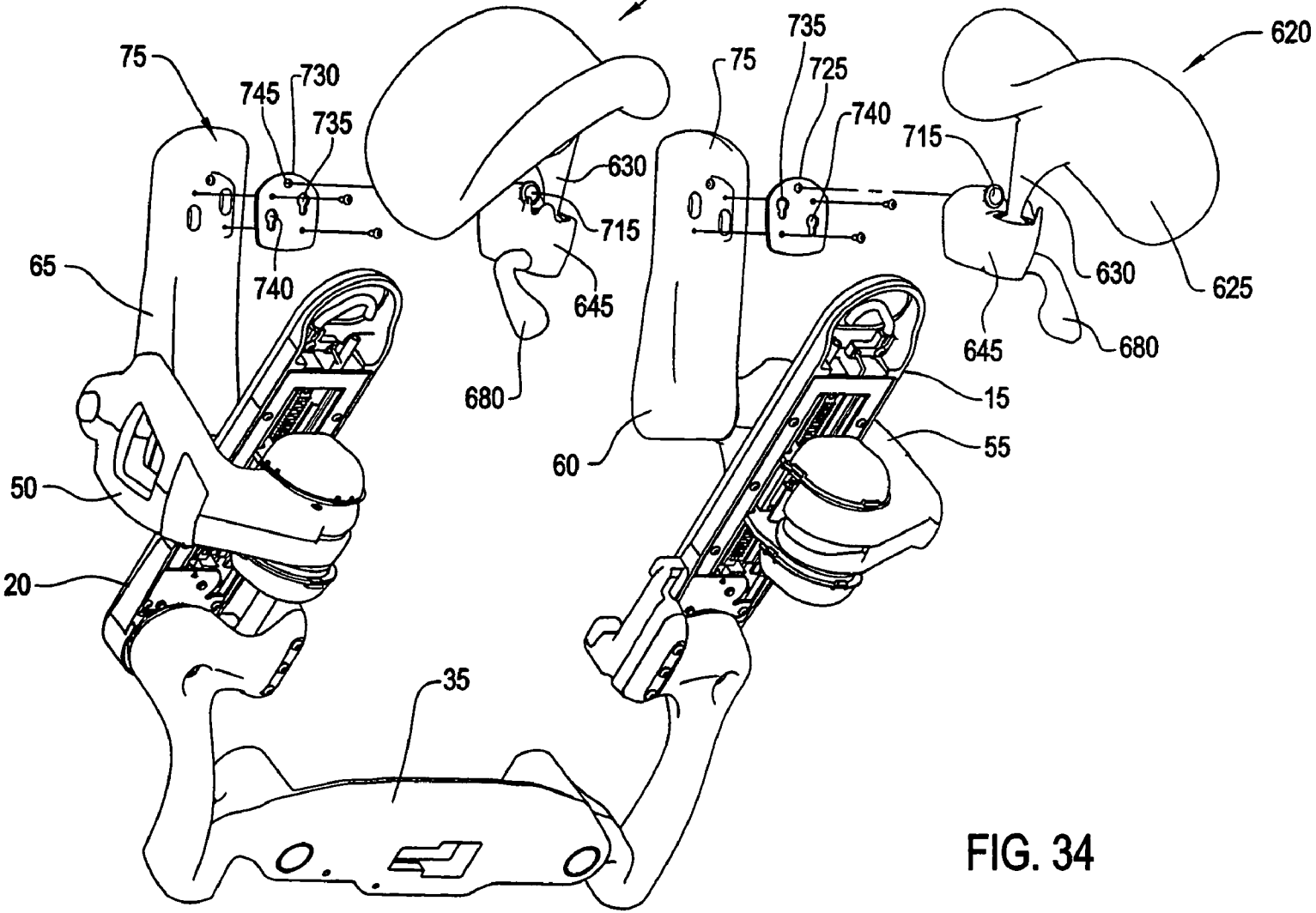
FIG. 34 is an exploded perspective view of the mounting mechanism of the calf support assembly of FIGS. 31-33 on the foot support of FIGS. 1-23.

The housing 645 is removably mounted to the reverse side 75 of the foot supports 60, 65 by the mounting studs 667, 668 and a retractable pin 710. The pin 710 is retractable into a cylindrical recess 712 by a user pulling on a knob 715 against the bias of an internal spring 720, shown in FIGS. 32-33. As shown in FIG. 34, a mounting plate 725, 730 is mounted on the reverse side 75 of each of the foot supports 60, 65. Each mounting plate 725, 730 includes a pair of keyhole apertures 735, 740 for receiving the mounting studs 667, 668. Each mounting plate 725, 730 further includes an aperture 745 for selectively receiving the pin 710. As the mounting studs 667, 668 are aligned with the keyhole apertures 735, 740, and the housing 645 pressed against the respective mounting plate 725, 730, the pin 710 is pushed by the mounting plate 725, 730 into the recess 712 against the bias of the spring 720. As the housing 645 is shifted downwardly to move the mounting studs 667, 668 into the narrow portion of the keyhole apertures 735, 740, the pin 710 moves into alignment with the aperture 745. The pin 710 enters the aperture 745 under the urging of the spring 720, locking the housing 645 in position on the mounting plate 725, 730. To remove the calf support assembly 620 from the foot support 60, 65, the attendant pulls on the knob 715 to retract the pin 710 from the aperture 745, allowing the housing 645 to slide upwardly and align the mounting studs 667, 668 with the enlarged portions of the keyhole apertures 735, 740.

A further embodiment of a calf support assembly 820 is shown in FIGS. 37-40. The calf support assembly 820 includes a calf support 825 on a stanchion 830. A phenolic ball 835 is formed on the lower portion of the stanchion 830. A sleeve 840 is slideably received in a calf support housing 845 and includes a cup 850 configured for receiving the phenolic ball 835. A locking ring 855 is placed over the phenolic ball 835 and a retaining ring 860 is inserted into a groove 865 in the housing 845 to retain the phenolic ball 835 between the locking ring 855 and the sleeve 840. A mounting stud 867 is secured to the housing 845.

Figure 38:
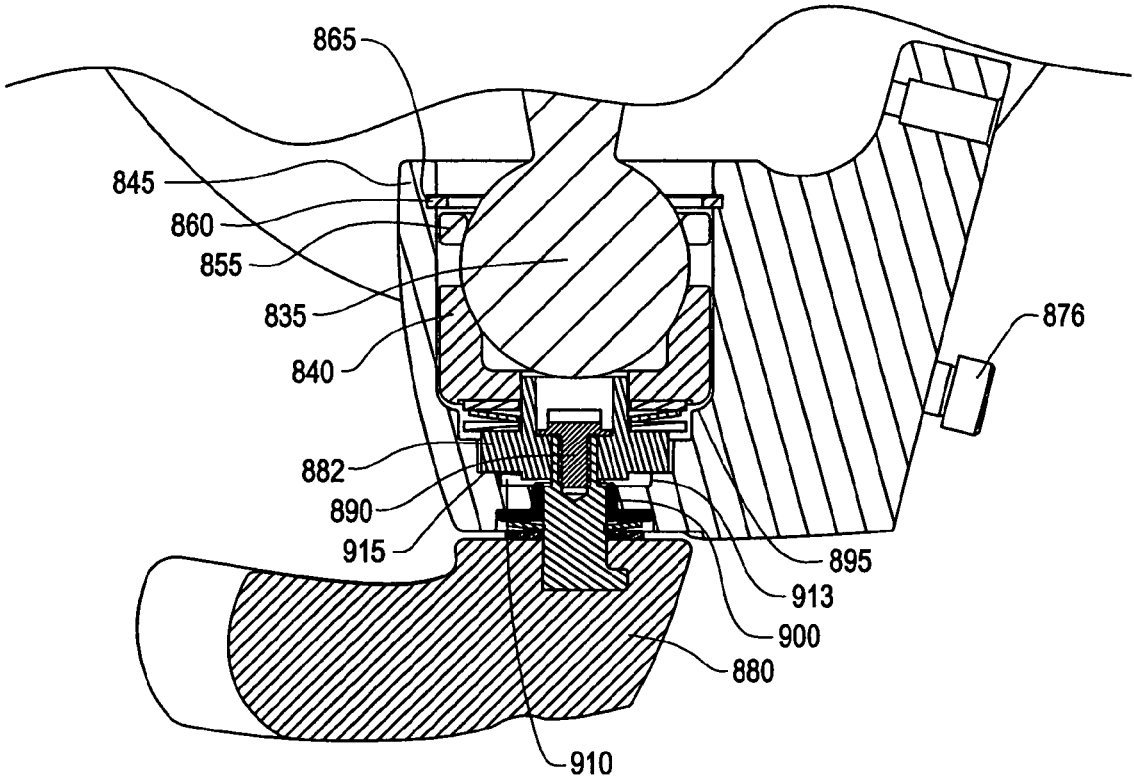
FIG. 38 is a partial cross-sectional view of the assembled calf support assembly of FIG. 37 in an unlocked position.
Figure 39:
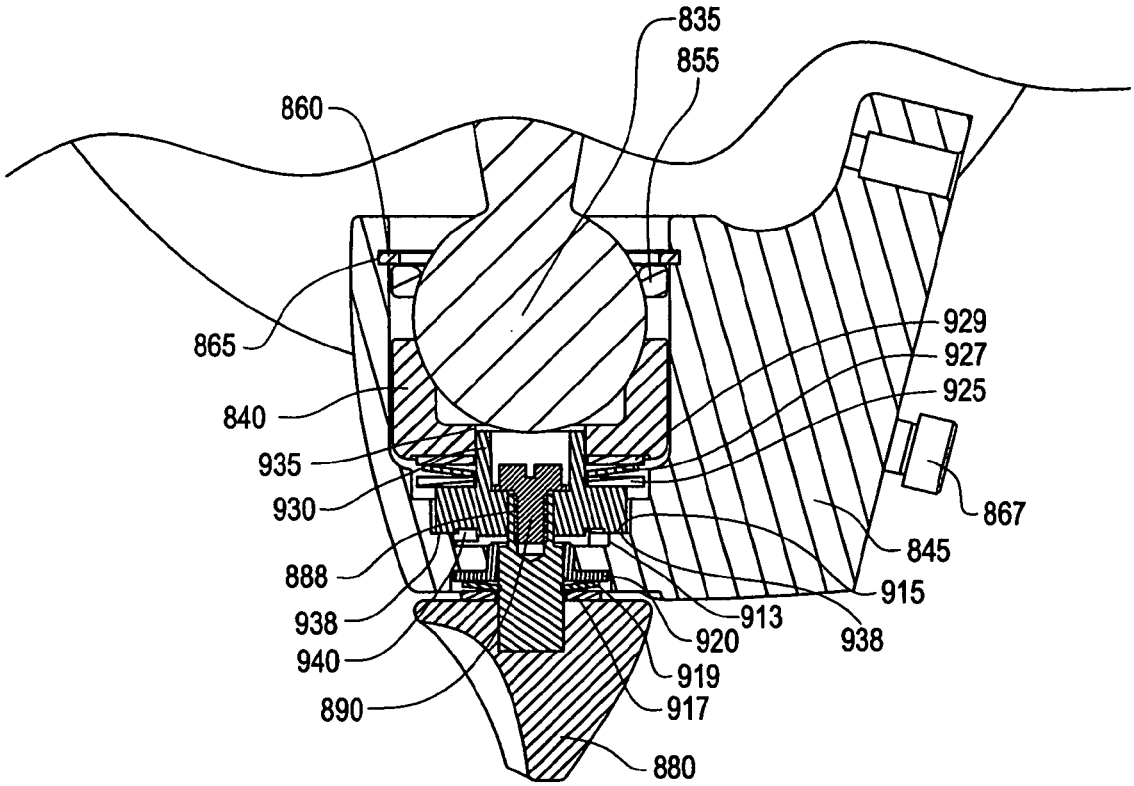
FIG. 39 is a partial cross-sectional view of the assembled calf support assembly of FIGS. 37-38 in a locked position.
Figure 40:
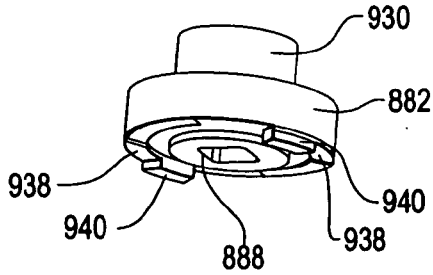
FIG. 40 is a perspective view of a cam element of the calf support assembly of FIGS. 37-39.

The housing 845 further includes a cam-like mechanism 875. The cam-like mechanism 875 includes a handle 880 and a cam element 882. The handle 880 includes a keyed shaft 884 having a threaded aperture 886 in an end thereof. The cam element 882 has a corresponding keyed aperture 888 for receiving the keyed shaft 884 of the handle 880. As best shown in FIGS. 38-39, a threaded fastener 890 secures the cam element 882 to the handle 880 with the keyed shaft 884 received in the keyed aperture 888.

Figure 41:
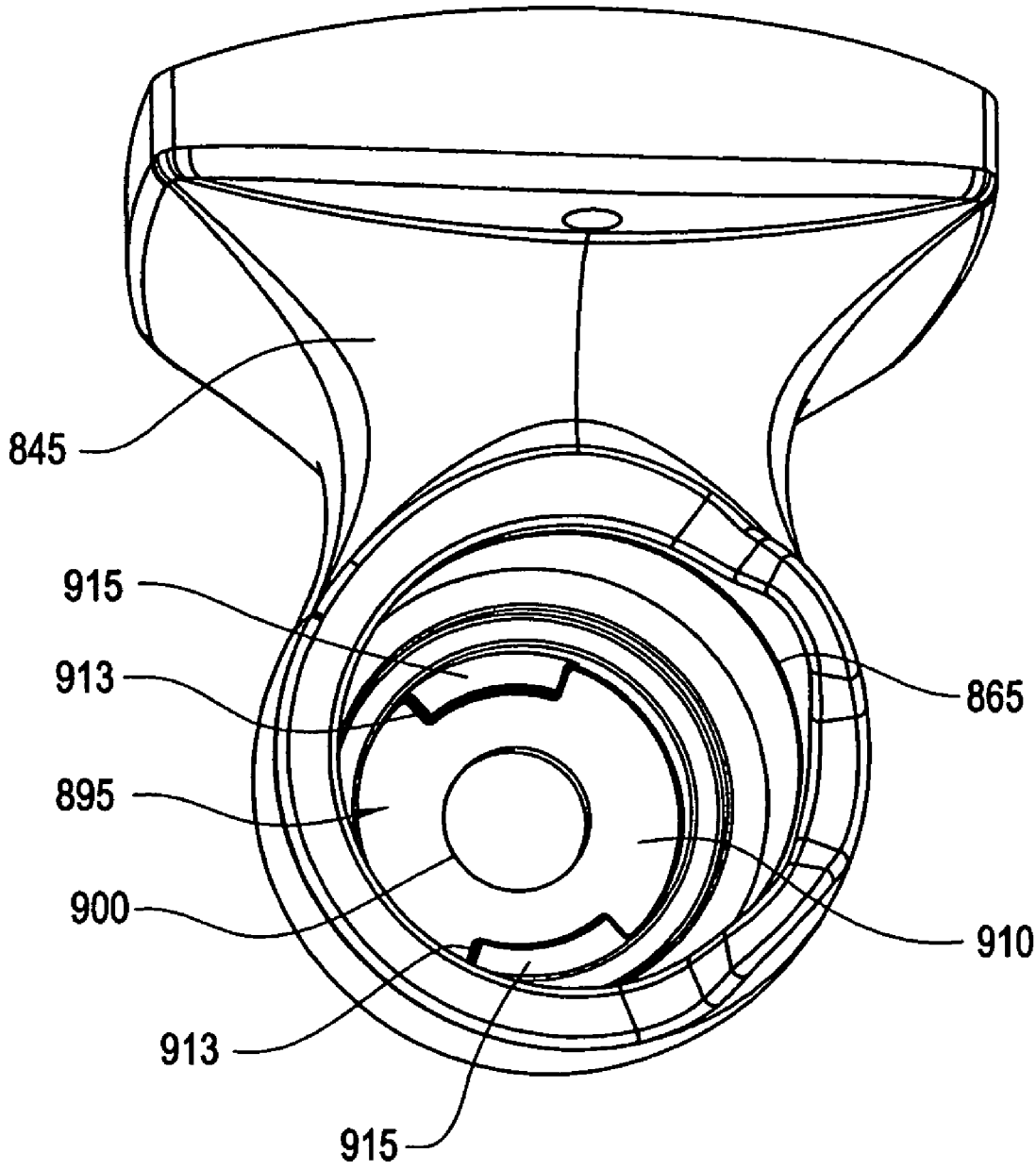
FIG. 41 is a perspective view of the interior of the housing of the calf support assembly of FIGS. 37-40.

The housing 845 includes a substantially cylindrical cavity 895 configured for receiving the sleeve 840 and other elements of the cam-lock mechanism 875. The cavity 895 includes an aperture 900 in a bottom portion thereof for receiving the keyed shaft 884 of the handle 880. As shown in FIG. 41, a lower surface 910 of the cavity 895 includes a stepped portion 913 having a ramped surface 915.

The cam-lock mechanism 875 is assembled within the housing 845 by the placement of a flat washer 917, a spring washer 919 and a bushing 920 over the keyed shaft 884 of the handle 880. This assembly is then inserted through the aperture 900 at the base of the cavity 895 so that the bushing 920 is received in the aperture 900, with the keyed shaft 884 passing therethrough. The cam element 882 is inserted through the upper portion of the cavity 895 so that the keyed aperture 888 receives the keyed shaft 884. The fastener 890 is then threadably received in the threaded aperture 886 of the keyed shaft 884 to fix the cam element 882 onto the keyed shaft 884. A flat washer 925, a spring 927, and a flat washer 929 are then received on the cam element 882, followed by the sleeve 840. The cam element 882 includes an upper portion 930 that is slideably received through an aperture 935 in the base of the sleeve 840. The phenolic ball 835 is then received in the sleeve 840 and is secured within the cavity of the housing 845 by the locking ring 855 and the retaining ring 860.

The cam element 882 is further formed with opposing ramped lower surfaces 938 configured for engaging the ramped surface 915 in the cavity 895 of the housing 845. As the handle 880 is rotated, the ramped surfaces 938 traverse the ramped portion 915, forcing the cam-lock mechanism 875 toward or away from the phenolic ball 835. As the cam-lock mechanism 875 is forced toward the phenolic ball 835, the sleeve 840 pushes the phenolic ball against the locking ring 855, locking the calf support 825 in place. The cam element 822 is further formed with rotation stops 940. As the cam element 822 is rotated, approximately 90°, the rotation stops 940 abut the stepped portion 913, preventing further rotation of the cam element 822.

In order to release the calf support 625, the handle 880 is rotated back to the position shown in FIG. 38, releasing the locking pressure on the phenolic ball 835. In the unlocked position shown in FIG. 38, the sleeve 840 bears against the phenolic ball 835 with a reduced force generated by the spring washer 927 mounted between the flat washers 925, 929 and the cam element 882 and the sleeve 840. The spring washer 919, mounted between the handle 880 and the bushing 920, acts to keep the cam element 882 seated against the ramp surface 915 throughout its range of motion.

OPERATION

The foot support and abduction assembly 10 according to the invention are substantially configured for one-handed operation by an attendant. In order to rotate the abductor 20 about pivot axis 110, an attendant need only grasp the distal end 194 of the abductor 20, simultaneously grasping the handle 190 to release the locking arm 155 from the ring gear 140. The abductor 20 is thereby free to rotate about the axis 110. Upon release of the handle 190 by the attendant, the abductor 20 is locked in its newly adjusted position.

The upright assembly 55 is slidably mounted on the abductor 20. In order to move the upright assembly 55 in a longitudinal direction on the abductor 20, the attendant need only grasp one of the first handle 330 or the second handle 335, thereby releasing the locking arm 260 and allowing the upright assembly 55 to slide longitudinally on the abductor 20. Since the attendant need only grasp one of the handles 330, 335, the attendant can move the upright assembly 55 while at the foot of the bed or at the head of the bed.

The foot support 65 is rotatable from a first position wherein the foot support 65 is available for use by a patient, and a second position wherein the calf support assembly 70, 570, 620 is presented to the patient. The foot support 65 is rotatable about the axis 105 and is released by an attendant depressing the push button 425, placing the attendant in a convenient position for rotating the foot support 65. As necessary, the calf support 70, 570, 620 is readily removable by an attendant by pulling outwardly on knob 715 to retract the pin 710 from the aperture 745, allowing the housing 645 to slide upwardly and align the mounting studs 667, 668 with the enlarged portions of the keyhole apertures 735, 740.

The upright assembly 55 is rotatably mounted to the abductor 20, from an upright deployed position to an under-bed stowed position. The upright assembly 55 is released to rotate to the under-bed stowed position by an attendant pulling on the stow-lever handle 475. While grasping the stow-lever handle 475, the attendant's hand is in position to support the upright assembly 55 for lowering. Once the pin 465 has cleared the aperture 470 of the hub 460, the attendant can release the handle 475 and, in a one-handed fashion, lower the upright assembly 55 to the stowed position. The upright assembly 55 will only rotate until the pin 465 reaches the stop/detent 507 of the hub 460. As the upright assembly 55 is lowered to the stowed position, the cam feature 510 operates to shift the cam wedge 275, thereby releasing the locking arm 260 to permit longitudinal movement of the upright assembly 55 on the abductor 20. The attendant can thereby conveniently lower the upright assembly 55 and shift it longitudinally on the abductor 20 with one hand.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A calf support assembly for mounting to a foot support of a maternity bed, comprising:

a housing for removably attaching the calf support assembly to the foot support, the housing comprising a spring biased pin for releasably securing the housing to the foot support and at least one mounting stud configured for insertion into a keyhole aperture on the foot support;

a calf support portion adjustably mounted to the housing by a ball-type pivot mount; and an adjustment mechanism for selectively fixing the position of the calf support portion relative to the housing.

2. The calf support assembly of claim 1, wherein the adjustment mechanism comprises a slidable sleeve for locking the ball-type pivot mount in the housing.

3. The calf support assembly of claim 2, wherein the adjustment mechanism further comprises a threaded rod for selectively sliding the sleeve between a locked and an unlocked position, the threaded rod including a T-locking handle.

4. The calf support assembly of claim 2, wherein the adjustment mechanism further comprises a threaded rod for selectively sliding the sleeve between a locked and an unlocked position, the threaded rod including a vice-type handle.

5. The calf support assembly of claim 2, wherein the adjustment mechanism further comprises a cam-lock mechanism arranged in the housing to selectively slide the sleeve between a locked and an unlocked position.

6. The calf support assembly of claim 5, wherein the cam-lock mechanism comprises a cam shaft rotatably supported within the housing and a handle fixed to the cam shaft.

7. The calf support assembly of claim 1, wherein the calf support portion comprises a thermoformed insert and a urethane over-molded cover.

8. A calf support assembly according to claim 1, further in combination with a foot support having an undersurface, and said housing attached to the undersurface of the foot support.

9. The calf support assembly of claim 8, further in combination with at least one abductor configured for pivotal attachment proximate a maternity bed foot section and an upright assembly having a first end that is secured to the abductor for longitudinal movement along a length of said abductor and a second end to which the foot support is movably mounted.

10. A foot support and abduction assembly including:

at least one abductor configured for pivotal attachment proximate a maternity bed foot section;

a foot support;

an upright assembly having a first end that is secured to the abductor for longitudinal movement along a length of said abductor and a second end to which the foot support is movably mounted; and a calf support assembly attached to an undersurface of the foot support, the calf support assembly being removably attached to the foot support and comprising a housing removably attaching the calf support assembly to the foot support, wherein the calf support assembly further comprises at least one mounting stud mounted on the housing and configured for insertion into a keyhole aperture on the foot support.

11. The foot support and abduction assembly of claim 10, wherein the housing of the calf support assembly further comprises a spring-biased mechanism for removably attaching the calf support assembly to the foot support.

12. A foot support and abduction assembly including:

at least one abductor configured for pivotal attachment proximate a maternity bed foot section;

a foot support;

an upright assembly having a first end that is secured to the abductor for longitudinal movement along a length of said abductor and a second end to which the foot support is movably mounted; and a calf support assembly attached to an undersurface of the foot support, the calf support assembly being removably attached to the foot support and comprising a housing removably attaching the calf support assembly to the foot support, wherein the calf support assembly further comprises a spring-biased pin mounted in the housing for releasably securing the housing to the foot support.

13. The foot support and abduction assembly of claim 12, wherein the calf support assembly comprises a calf support portion adjustably mounted to the housing.

14. The foot support and abduction assembly of claim 13, further comprising an adjustment mechanism for selectively fixing the position of the calf support portion relative to the housing.

15. The foot support and abduction assembly of claim 14, wherein the calf support portion is mounted to the housing by a ball-type pivot mount.

16. The foot support and abduction assembly of claim 15, wherein the adjustment mechanism comprises a slidable sleeve for locking the ball-type pivot mount in the housing.

17. The foot support and abduction assembly of claim 16, wherein the adjustment mechanism further comprises a threaded rod for selectively sliding the sleeve between a locked and an unlocked position, the threaded rod including a T-locking handle.

18. The foot support and abduction assembly of claim 16, wherein the adjustment mechanism further comprises a threaded rod for selectively sliding the sleeve between a locked and an unlocked position, the threaded rod including a vice-type handle.

19. The foot support and abduction assembly of claim 16, wherein the adjustment mechanism further comprises a cam-lock mechanism arranged in the housing to selectively slide the sleeve between a locked and an unlocked position.

20. The foot support and abduction assembly of claim 19, wherein the cam-lock mechanism comprises a cam shaft rotatably supported within the housing and a handle attached to the cam shaft.

21. The foot support and abduction assembly of claim 20, wherein the handle is removably attached to the cam shaft.

22. The foot support and abduction assembly of claim 19, wherein the cam-lock mechanism comprises a ramped portion within the housing and a rotatable cam element having a ramped surface positioned over the ramped portion of the housing.

23. The foot support and abduction assembly of claim 22, wherein the cam-lock mechanism further comprises a handle removably attached and rotatably affixed to the cam element.

24. The foot support and abduction assembly of claim 23, wherein the handle is a paddle-type handle.

25. The foot support and abduction assembly of claim 13, wherein the calf support portion comprises a thermoformed insert and a urethane over-molded cover.

* * * * *